US010502025B2

(12) United States Patent
van Petegem et al.

(10) Patent No.: US 10,502,025 B2
(45) Date of Patent: Dec. 10, 2019

(54) STEAM DIVERSION ASSEMBLY

(71) Applicant: PACKERS PLUS ENERGY SERVICES INC., Calgary (CA)

(72) Inventors: Ronald van Petegem, Montgomery, TX (US); Craig Skeates, Calgary (CA); John Lee Emerson, Katy, TX (US); Chris Desranleau, Ardrossan (CA)

( * ) Notice: Subject to any disclaimer, the term of this patent is extended or adjusted under 35 U.S.C. 154(b) by 257 days.

(21) Appl. No.: 15/448,083

(22) Filed: Mar. 2, 2017

(65) Prior Publication Data

US 2017/0254176 A1 Sep. 7, 2017

Related U.S. Application Data

(60) Provisional application No. 62/302,552, filed on Mar. 2, 2016.

(51) Int. Cl.

| | |
|---|---|
| ***E21B 34/10*** | (2006.01) |
| ***E21B 34/06*** | (2006.01) |
| ***E21B 43/24*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/063* (2013.01); *E21B 34/14* (2013.01); *E21B 43/2406* (2013.01); *E21B 2034/007* (2013.01)

(58) Field of Classification Search

CPC ..... E21B 34/063; E21B 34/10; E21B 34/14; E21B 43/2406; E21B 2034/007

See application file for complete search history.

(56) References Cited

U.S. PATENT DOCUMENTS

| | | | | |
|---|---|---|---|---|
| 4,099,563 | A | 7/1978 | Hutchinson et al. | |
| 7,581,596 | B2 * | 9/2009 | Reimert | E21B 23/04 166/386 |
| 7,631,694 | B2 | 12/2009 | Struyk et al. | |
| 7,762,333 | B2 | 7/2010 | Themig et al. | |
| 7,861,774 | B2 | 1/2011 | Fehr et al. | |
| 8,261,761 | B2 | 9/2012 | Gerrard et al. | |
| 9,574,421 | B1 * | 2/2017 | Saraya | E21B 34/14 |
| 2009/0308614 | A1 * | 12/2009 | Sanchez | E21B 34/14 166/328 |
| 2011/0203800 | A1 * | 8/2011 | Tinker | E21B 34/14 166/318 |
| 2012/0199353 | A1 | 8/2012 | Fermaniuk et al. | |
| 2013/0186623 | A1 | 7/2013 | Waterhouse et al. | |
| 2016/0215589 | A1 * | 7/2016 | Sanchez | E21B 34/14 |

OTHER PUBLICATIONS

Scott Hobbs and Peter Ficocelli "PTAC—Optimized Steam Control," Mar. 12, 2012, 26 pages.

* cited by examiner

*Primary Examiner* — Yong-Suk Ro

(57) ABSTRACT

Embodiments described herein relate to injecting steam into a wellbore using a device. The device includes a body having a bore configured to communicate steam through the body. The device also includes a sleeve movable in the bore of the body between a first position and a second position, wherein the sleeve in the first position blocks steam from exiting an opening of the body and the sleeve in the second position allows steam to exit the opening of the body. The device can be activated by an activation device conveyed down a tubing string and can include a seat on which the activation device. The seat is expandable to allow the activation device to pass.

11 Claims, 10 Drawing Sheets

STEAM DIVERSION ASSEMBLY

RELATED APPLICATIONS

This application claims the benefit of priority of U.S. Provisional Patent Application No. 62/302,552, entitled "Ball Drop Shiftable Steam Valve and Steam Diversion Chamber," filed Mar. 2, 2016, the entire contents of which are fully incorporated herein by reference for all purposes.

TECHNICAL FIELD

The present disclosure relates generally to steam injection for wells. More particularly, the invention relates to a method and an apparatus for injecting steam into a wellbore.

BACKGROUND

Steam injection is a standard technique for improving oil recovery from a well. In conventional Steam Assisted Gravity Drainage (SAGD) oil wells, there is a period of well warm up that entails injecting steam down a steam injection string and taking returns in a second string in a dual string configuration. This process is used to place heat into the reservoir in order to decrease viscosity of the bitumen in place, as well as establish communication between the injector and producer.

After the well has warmed up sufficiently and communication between the injector and producer has been established, it is often desirable to inject steam into a well at a location other than the bottom of the tubing. To this end, steam distribution devices through which steam can be injected into the surrounding bore from the steam injection string are often disposed at intervals along the injection string. These distribution devices are run-in in a closed position and maintained in the closed position during circulation in order to efficiently get heat down to the toe of the well and ensure circulation from the toe to the heel can be accomplished.

After a period of weeks/months, it is desirable to stop circulating and start injection of the steam. In order to accomplish this, a coiled tubing shifting tool (such as an Otis B shifting tool) is lowered into the injection string tubing on either coiled tubing or on small diameter tubing with a service rig. The shifting tool is used to open one distribution device at a time so that steam can pass from the central bore of the injection string to the annulus around the string. One disadvantage of these systems is that a coiled tubing unit and shifting tool are required to enter the well to open the valves. This operation introduces additional costs, risks and time compared with the invention proposed.

Some conventional steam splitter designs inject steam into the annulus through nozzles placed at right angles in the wall of the tubing on the injection string. This direct flow against other tubulars can lead to erosion in circumstances where fluid rates are high and liquid is present. Over time, the steam jetting can cut control lines, cut the sand control mechanism of the liner and generally cause wellbore damage.

SUMMARY

Embodiments described herein provide steam diversion assemblies, steam valves, flow control assemblies and related methods.

According to one embodiment, a steam diversion assembly for wellbore operations comprises a housing having an opening through the housing and a first sleeve selectively movable within the housing from a valve closed position covering the opening to a valve open position in which the opening through the housing is exposed to an inner bore of the steam diversion assembly. An activation device may be used to shift the first sleeve. To this end, the steam diversion assembly may include an expandable seat coupled to the first sleeve on which an activation device conveyed down a tubing string can land. The expandable seat can shift the first sleeve from the valve closed position to the valve open position. The expandable seat may be expandable from a first seat configuration having a first inner diameter selected to seat the activation device to a second seat configuration that allows the activation device to pass through the expandable seat. Consequently, the activation device may flow through the expandable seat once the valve is open.

In accordance with one embodiment, the first sleeve may define a seat retaining area in which the seat is held during run-in. The expandable seat is selectively movable from the seat retaining area to a seat expansion area that has a larger inner diameter than the seat retaining area. When the seat is positioned at the seat expansion area, the seat can expand from the first seat configuration to the second seat configuration.

The steam diversion assembly may further include a releasable seat engagement mechanism that has a first releasable seat engagement mechanism configuration that retains the expandable seat in the seat retaining area of the first sleeve such that the expandable seat and sleeve move together. The releasable seat engagement mechanism is further configurable in a second releasable seat engagement mechanism configuration that allows the expandable seat to move relative to the first sleeve so that the expandable seat can move from the seat retaining area to the seat expansion area.

According to one embodiment, the releasable seat engagement mechanism includes an inner sleeve movable relative to first sleeve from a first inner sleeve position to a second inner sleeve position to open the expansion area for the expandable seat. The expandable seat is selectively movable from the seat retaining area to shift the inner sleeve from the inner sleeve first position to the inner sleeve second position to open the seat expansion area. When the expandable seat is positioned at the seat expansion area, the expandable seat can expand into the expansion area.

The steam diversion assembly may include a first releasable setting mechanism for the shift sleeve to prevent the shift sleeve from shifting from the valve closed position to the valve open position until a first threshold force is applied to the expandable seat and a second releasable setting mechanism for the expandable seat to prevent the expandable seat from moving from the seat retaining area to the expansion area until a second threshold force is applied to the expandable seat. The second threshold force greater than the first threshold force.

The steam diversion assembly may further comprise a second sleeve movable within the housing to close the valve after the first sleeve has shifted to open the valve. The second sleeve can be movable from a first position in which the second sleeve does not cover the at least one opening to a second valve closed position in which the second sleeve covers the opening through the housing.

The steam diversion assembly may include a flow control assembly disposed about a circumference of the housing to redirect steam longitudinally. According to one embodiment, the flow control assembly comprises a steam flow channel from a steam flow channel inlet to a steam flow channel outlet. The steam flow channel can be configured to cause a desired pressure drop. The steam flow channel may be defined by erosion resistant surfaces formed by erosion resistant materials, including, but not limited to, heat treated materials, ceramic materials, ceramic coated materials, tungsten carbides or tungsten carbide coated materials.

In accordance with one embodiment, the steam flow channels may be defined by one or more inserts. The inserts may be formed of an erosion resistant material including, but not limited to a heat treated material, ceramic, ceramic coated material, tungsten carbide or a tungsten carbide coated material. The one or more inserts can be configured to achieve a desired pressure drop.

An insert may include a steam inlet in fluid communication with the opening through housing of the valve and define a steam flow channel from the steam inlet to a steam outlet and the steam outlet may be longitudinally displaced from the steam inlet. The steam flow channel may be shaped to achieve a desired pressure drop. According to one embodiment, the insert comprises a nozzle proximate to the steam outlet, the nozzle shaped to direct steam primarily longitudinally into wellbore.

In accordance with another aspect, a method of injecting steam into a wellbore is provided. The method can comprise running in an injection string into a wellbore where the injection string includes a plurality of steam diversion assemblies. Each steam diversion assembly may include a valve and a flow control assembly. The valve of each steam diversion assembly may be opened to divert steam to the flow control assembly of that steam diversion assembly.

The method can further include conveying a series of activation devices down the injection string to selectively open the valves of the plurality of steam diversion assemblies. More particularly, in one embodiment, each steam diversion assembly can include an expandable seat on which a corresponding activation device can land. The expandable seat of each of the plurality of steam diversion assemblies can be coupled to sleeve movable within the steam diversion assembly from a valve closed position covering at least one opening to a valve open position exposing the at least one opening to an inner bore of the steam diversion assembly. The valve of each the plurality of steam diversion assemblies can opened by landing a corresponding activation device in the series of activation devices on the expandable activation device seat and shifting the sleeve of the assembly to the valve open position using a pressure differential established across the seat. According to one embodiment, the expandable activation device seat at an assembly can be expanded after the sleeve has been shifted to allow the corresponding activation device to pass through the steam diversion assembly. In some embodiments, steam diversion assemblies can be repeatedly closed and reopened using a shifting tool.

Steam can be pumped down the injection string and into the wellbore through the plurality of steam diversion assemblies. According to one embodiment, the deepest steam diversion assembly of the plurality of steam diversion assemblies has a less restrictive flow control assembly than the shallowest steam diversion assembly from the plurality of steam diversion assemblies.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

DETAILED DESCRIPTION

Figure 1:
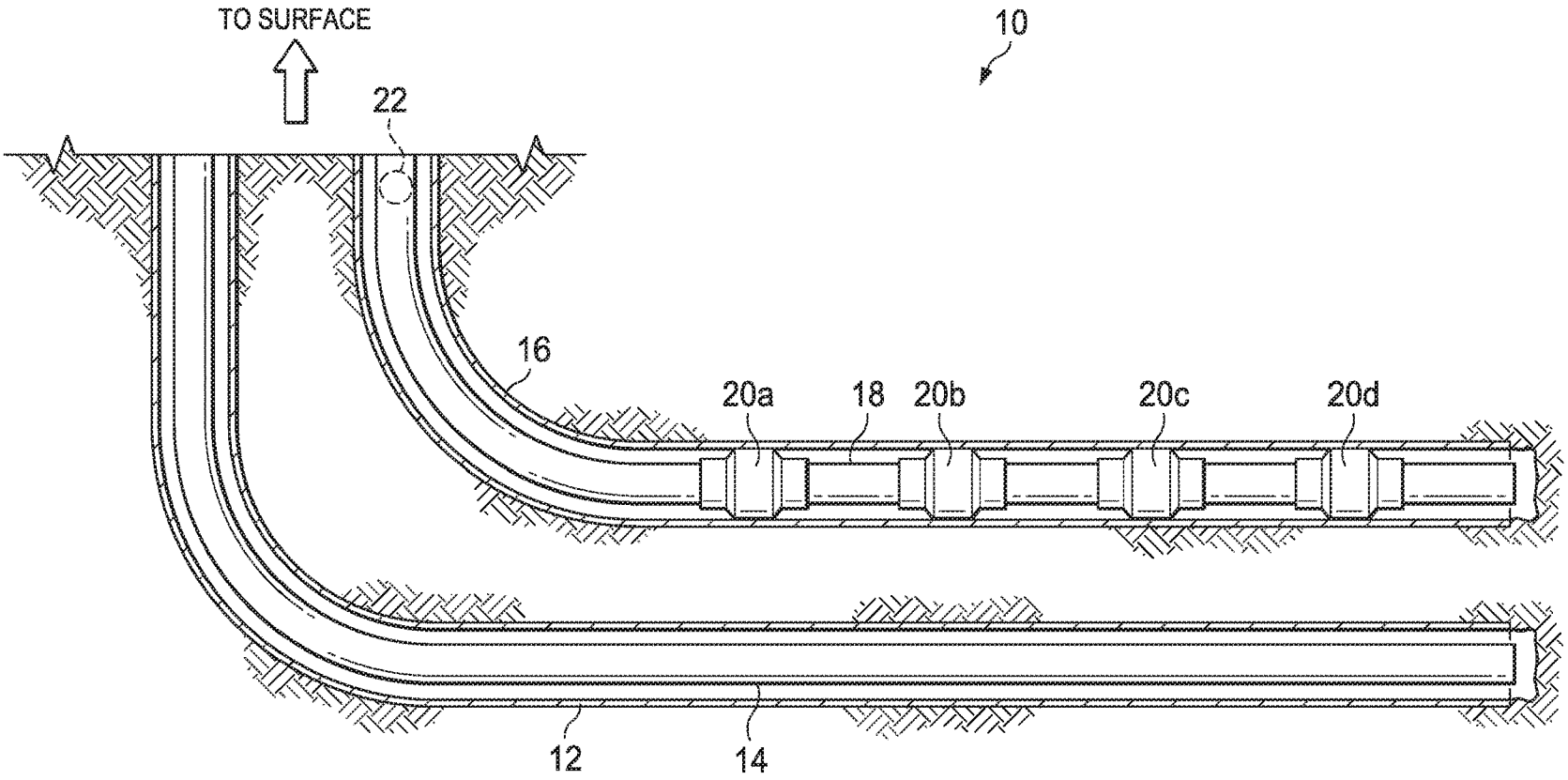
FIG. 1 depicts one embodiment of a steam assisted gravity drain well.

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure.

Embodiments described herein provide a steam diversion assembly that can be placed in a well and opened through the conveying of an activation device (e.g., a ball, dart, etc.)

down the string. The steam diversion assembly comprises a valve with a seat on which the activation device can land to activate the valve. The seat can expand to a configuration that allows the activation device to pass, thereby allowing the activation device to exit the valve once the valve has been activated.

The valve may comprise one or more sleeves movable in a housing to selectively cover/uncover openings through the housing wall, thus closing/opening the valve. In one embodiment, a (first) sleeve is coupled to the expandable activation device seat. An activation device can land on the seat and create a sufficient seal with the seat or other portion of the steam diversion assembly so that a pressure differential can be established across the seat to drive the seat and sleeve to which it is coupled to the lower pressure side. In this manner, the sleeve can be shifted from a valve closed position in which the sleeve covers the openings through the housing to a valve open position in which the openings through the housing are exposed to the inner bore of the valve. When particular conditions are met, the expandable seat can expand to allow the activation device to pass.

With the valve in the open position, at least a portion of the steam pumped down an injection string may pass from the inner bore of the valve to the annulus through a flow control assembly. The flow control assembly can divert steam longitudinally so that the steam does not jet straight outward. The flow control assembly can, for example, can include flow channels that may divert the flow of steam axially along the steam diversion assembly in one or more directions. According to one embodiment, the flow channels may also be shaped (including sized) to achieve a desired pressure drop. According to one embodiment, the flow channels may be formed by walls made of or coated with an erosion-resistant material such as ceramic, tungsten carbide or other material. In some embodiments, the erosion-resistant material may be a heat treated material.

In one embodiment, the movable sleeve may be shifted (e.g., using a shifting tool) back to its original position (or other position) to close the valve. In another embodiment, a second sleeve movable in the housing is provided. The second sleeve may contain a feature allowing it to be moved with a shifting tool so that the second sleeve covers the openings through the housing wall to close the valve.

One advantage of a ball (or other activation device) opened steam diversion assembly as disclosed herein is eliminating the need for a coiled tubing shifting tool to be run in a wellbore to open a steam diversion device after the well is completed its circulation phase. This elimination of re-entry of a well will reduce the overall completion costs by eliminating the coiled tubing unit and shifting tool that is currently required. It also eliminates the risk of a well event (parting coil, tool failures of the shifting tool, etc.).

One advantage of the flow control assemblies herein is minimizing wellbore damage that can arise from other designs. Steam of 550 degrees Fahrenheit or more may be used in SAGD, which is highly erosive to components directly exposed, such as well casing. A flow control assembly may include a pressure drop device to control the flow geometry and ensure that the steam flow path in the pressure drop device is fully contained in an erosion-resistant material such as ceramic, tungsten carbide or other material. The pressure drop device may fully take the pressure drop of the steam required to balance the injection over the horizontal length of the steam injection string while helping ensure that steam exits the flow control device substantially axially with the long axis of the string. By having the entirety of the pressure drop of the steam being contained within an erosion resistant flow channel, erosion in flow control assembly can be reduced or eliminated.

An additional advantage of some embodiments of flow control assemblies as disclosed herein is that different inserts may be used as pressure drop devices to control pressure drop. The direction, velocity and/or flow rate of the steam may be controlled by the use of different inserts.

Before proceeding further, it should be noted that the terms "upper", "back", "rear" are used to refer to being on or closer to the surface side (upwell side) relative to a corresponding feature that is "lower", "forward", "front". For example, an "upper" sleeve of a steam diversion assembly generally refers to the feature relatively closer to the back of the steam diversion assembly (upwell side of the steam diversion assembly) than a corresponding "lower" sleeve. However, both or neither of the "upper" and "lower" sleeves may be on the "upper" half of the steam diversion assembly depending on configuration. A feature that may be referred to as an "upper" feature relative to a "lower" feature even if the features are vertically aligned as may occur, for example, in a horizontal well.

Embodiments described herein may be used in a variety of wellbore operations, including, but not limited to Steam Assisted Gravity Drain (SAGD) operations. In starting a SAGD well, steam is first circulated through injection tubing string to warm up the well. Circulation may last for several months.

Once the well is warmed up, steam is injected in the injection well while oil is recovered from the production well.

Referring to FIG. 1, an embodiment of a SAGD well system 10 is shown. In a typical SAGD operation, there are two coextensive horizontal wells, a production bore 12 and an injection bore 16. As shown in FIG. 1, a production tubing string 14 is disposed in production bore 12 and an injection tubing string 18 is disposed in injection bore 16. A steam generator located at the surface injects steam down injection tubing string 18 and through one or more steam diversion assemblies 20 (individually shown as steam injection assemblies 20*a-d*) to heat the surrounding formation. During production, production tubing string 14 transports produced hydrocarbons back to the surface.

As will be described herein, the steam diversion assemblies 20 can be selectively moved between a closed position and an opened position. In particular, one or more steam diversion assemblies 20 may be actuated by introducing an activation device 22 (e.g., an untethered activation device such as ball or dart) into injection tubing string 18. Activation device 22 may come in various diameters and may be dropped or pumped from the surface. When activation device 22 encounters a steam diversion assembly 20 designed to be activated by an activation device of the size of activation device 22, activation device 22 may activate (e.g. open) the steam diversion assembly 20. For example, steam diversion assemblies 20 may be sized such that the activation device size required to activate steam diversion assembly 20*a* is larger than that of 20*b* and the activation device size required to activate steam diversion assembly 20*b* is larger than that required to activate steam diversion assembly 20*c* and so on. In another embodiment, steam diversion assemblies 20 can be configured such that activation devices of the same size activate two or more steam diversion assemblies is the same.

In one possible opening sequence, steam diversion assembly 20*d* is opened first by dropping an appropriately sized activation device 22 down tubing string 18. Steam diversion assemblies 20*a*-20*c* may require larger activation devices to open and thus activation device 22 passes through steam diversion assemblies 20*a*-20*c* but activates steam diversion assembly 20*d*. Incrementally larger activation devices may be dropped to open steam diversion assemblies 20*c*, 20*b*, and 20*a*.

As discussed below, some embodiments of steam diversion assemblies 20 may include expandable activation device seats that can expand to allow the activation device to pass after the steam diversion assembly is opened. The expandable activation devices can be configured to expand a sufficient amount such that the various sized activation devices can pass. For example, in a non-expanded configuration, the expandable seat of steam diversion assembly 20*d* can be sized so that the smallest activation device (relative to the activation devices used to activate assemblies 20*a*-20*c*) can activate diversion assembly 20*d*. The seats, however, can expand so that the activation devices sized to activate assemblies 20 can pass. Thus, in some embodiments, activation devices may accumulate at the bottom of injection string 18 after the assemblies 20 are opened.

Figure 2A:
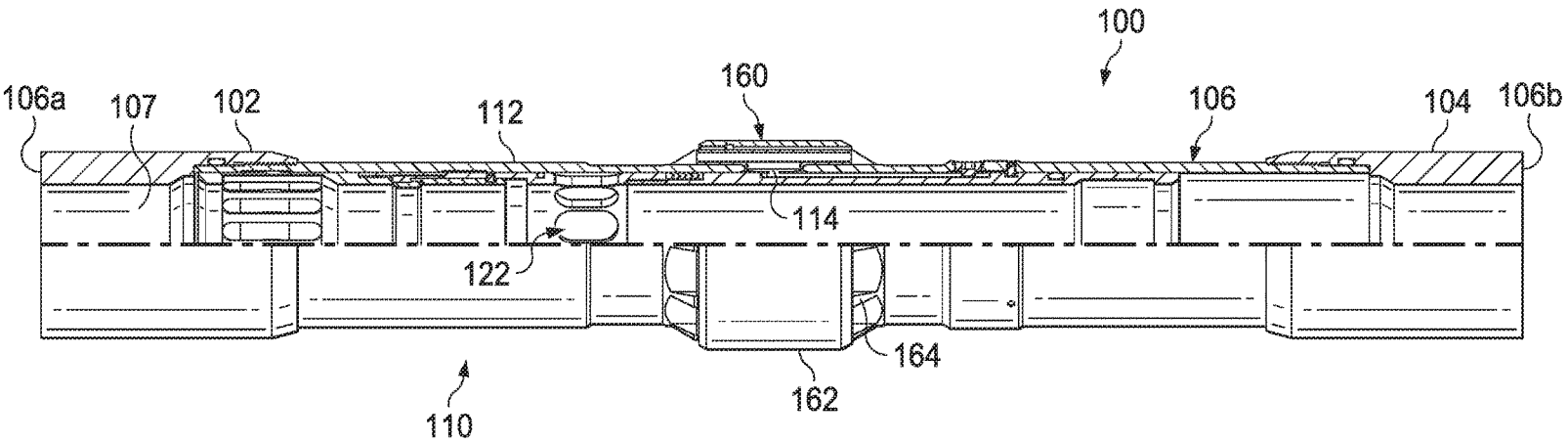
FIG. 2A is a cut-away view of one embodiment of a steam diversion assembly in a closed (run-in) configuration.
Figure 2B:
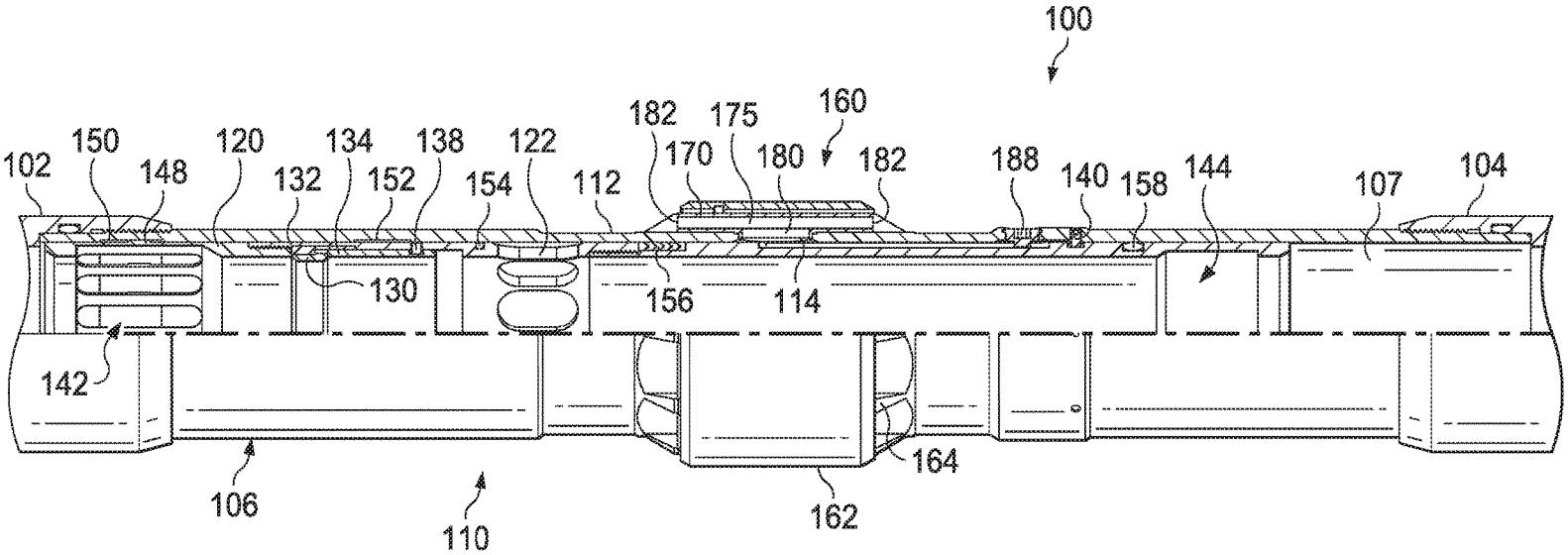
FIG. 2B illustrates the embodiment of the steam diversion assembly of FIG. 2A in more detail.
Figure 2C:
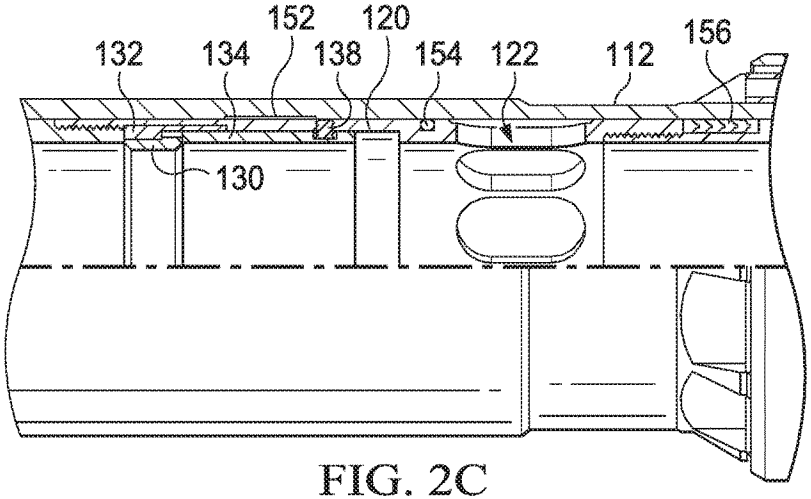
FIG. 2C illustrates an expandable seat of the steam diversion assembly of FIG. 2A in more detail.
Figure 2D:
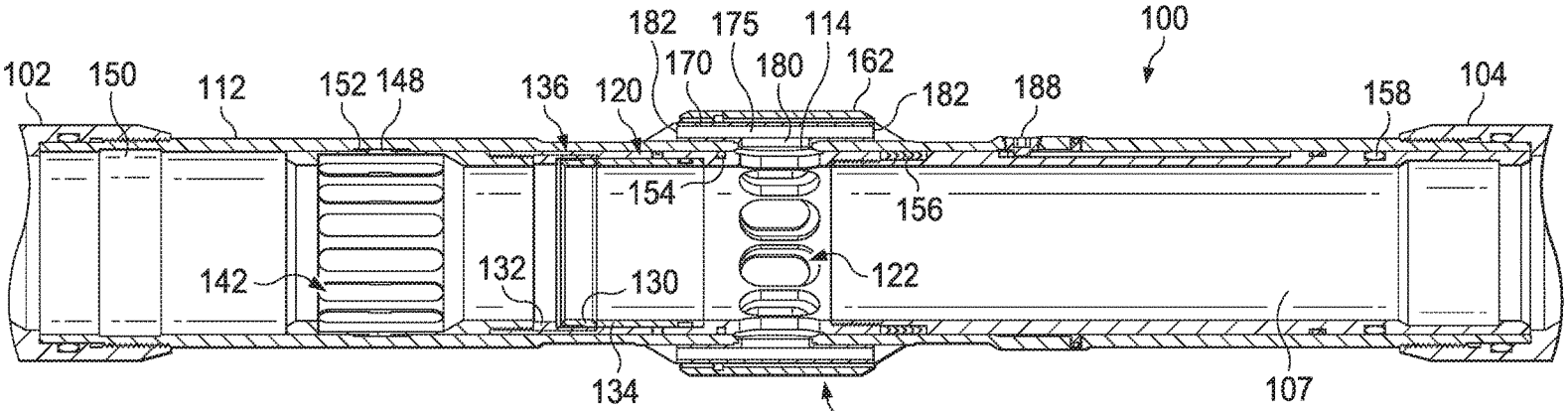
FIG. 2D is a cross-section view of one embodiment of the steam diversion assembly of FIG. 2A in a valve open configuration.
Figure 2E:
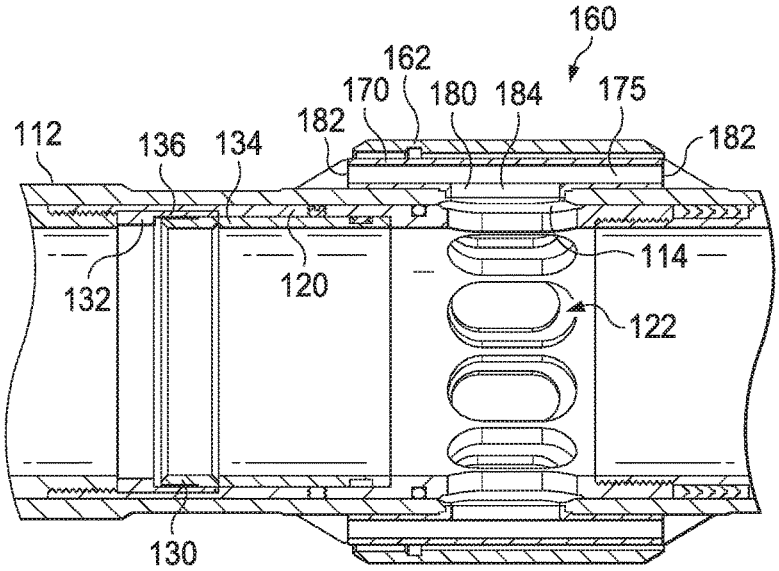
FIG. 2E illustrates one embodiment of the expandable seat in more detail for the configuration of FIG. 2D.

FIG. 2A, FIG. 2B, FIG. 2C, FIG. 2D and FIG. 2E (collectively FIG. 2) are diagrammatic representations of one embodiment of a steam diversion assembly 100 for use in wellbore operations including, but not limited to, SAGD operations. FIGS. 2A-2C illustrate cutaway views of steam diversion assembly 100 in a run-in (closed) configuration while FIGS. 2D-2E illustrate a cross-sectional view of steam diversion assembly 100 in an open position. Steam diversion assembly 100 may be used as a steam diversion assembly 20 of FIG. 1.

Steam diversion assembly 100 comprises an upper connection tubular 102, lower connection tubular 104, valve 110, and flow control assembly 160. Upper connection tubular 102, lower connection tubular 104 and valve housing 112 form a tubular body 106 having a bore 107 extending from a first end 106*a* to a second end 106*b* of tubular body 106. Valve housing 112 includes a plurality of valve openings 114 through the housing wall to provide fluid communication between bore 107 and flow control assembly 160. When valve 110 is in a closed position, valve openings 114 are covered and steam flows through bore 107 from one end of body 106 to the other end. When valve 110 is in an open position, steam can flow through valve openings 114 and into flow control assembly 160, which can provide fluid communication from bore 107 to the surrounding wellbore.

A shift sleeve 120 is disposed inside the body 106 and is selectively movable between a first position (a valve closed position) and a second position (a valve open position). A guide pin 188 may ride in a slot on the outer surface of sleeve 120 to prevent sleeve 120 from rotating out of alignment and shoulders or other features may limit the range of movement of shift sleeve 120. Shift sleeve 120 includes a plurality of sleeve openings 122 that are configured to act as fluid passageways when shift sleeve 120 is in the valve open position. In the embodiment illustrated, sleeve openings 122 are spaced and positioned such that sleeve openings 122 align with or at least partially overlap valve openings 114 when sleeve 120 is in a valve open position. The shift sleeve 120 in the first position is shown in FIGS. 2A-2C and corresponds to the steam diversion assembly 100 in a valve closed configuration. Shift sleeve 120 in the second position is shown in FIG. 2D-2E and corresponds to the steam diversion assembly 100 in a valve open configuration.

Shift sleeve 120 may include an expandable activation device seat on which an activation device, such as a ball, dart or other activation device conveyed down an injection string, can land. The activation device can create a sufficient seal with the seat or other portion of steam diversion assembly 100 such that pressure can be applied through the tubing string from the surface to create a pressure differential across the seat. The pressure differential drives sleeve 120 toward the low pressure side, opening valve 110.

One or more releasable setting mechanisms, such as one or more of a shear pin, a collet, a c-ring, or other releasable setting device, may be provided to hold shift sleeve 120 in the closed position until the holding force of the releasable setting device is overcome. In the illustrated embodiment, shear pins 140 are provided to maintain sleeve 120 in the closed position. Shear pins 140 can shear (release) when a sufficient differential pressure is established across the seat thereby allowing sleeve 120 to shift to an open position.

The activation device seat can be an expandable seat capable of dilating to allow the activation device to pass after valve 110 has opened. The activation device seat comprises an expandable seat ring 130 (e.g., a split ring, c-ring or other ring that can expand in diameter) that is axially movable relative to shift sleeve 120 from a first seat position corresponding to a first seat configuration in which ring 130 has a smaller diameter (FIG. 2A-2C) to a second seat position corresponding to a second seat configuration in which ring 130 has a larger diameter as illustrated in (FIG. 2D-2F). Seat ring 130 may be expandable such that, in the first seat configuration, the inner diameter of seat ring 130 is smaller than the outer diameter of an activation device selected to open valve 110 and, in the second seat configuration, the inner diameter of seat ring 130 is the same diameter or larger than the outer diameter of the activation device that activated valve 110 or, in some cases, the largest activation device used to activate a tool in the string. Thus, a corresponding activation device can land on seat ring 130 when seat ring 130 is in the first seat configuration and pass through seat ring 130 when seat ring 130 is in the second seat configuration.

With reference to FIG. 2C and FIG. 2E, when seat ring 130 is in the first seat ring position, seat ring 130 is retained in a seat retaining area in the inner bore of shift sleeve 120 having a diameter that prevents seat ring 130 from expanding. In the illustrated embodiment, a spacer 132 provides a constriction in which seat ring 130 is initially retained and compressed. Different sized spacers 132 may be used in different steam diversion assemblies 100 so that different assemblies 100 in the same string may be activated by different diameter activation devices.

Steam diversion assembly includes a releasable seat engagement mechanism to selectively release seat ring 130 from the seat retention area. When released, ring 130 can shift relative to sleeve 120 to a seat expansion area 136 (FIG. 2E) having a larger diameter than the seat retaining area. When positioned at seat expansion area 136, ring 130 can expand to allow activation devices to pass through ring 130.

The releasable seat engagement mechanism comprises an inner sleeve 134 disposed adjacent to ring 130 in sleeve 120 with the upper end of inner sleeve 134 abutting the lower face of ring 130. Inner sleeve 134 is selectively movable relative to shift sleeve 120 from a first inner sleeve position (FIG. 2C) to a second inner sleeve position (FIG. 2E) in an inner sleeve holding area that has an inner diameter greater than that of the outer diameter of ring 130 when ring 130 is in the seat retention area.

A releasable setting device (such as one or more of a shear pin, a collet, a c-ring, or other releasable setting device) holds inner sleeve 134 in position relative to shift sleeve 120 until the holding force of the releasable setting mechanism is overcome. In the illustrated embodiment, one or more shear pins 138 are provided to hold inner sleeve 134 relative to shift sleeve 120 until the holding force is overcome. Prior to release, inner sleeve 134 holds seat ring 130 in the seat retaining area. When shear pins 138 (or other releasable setting mechanism) release, however, seat ring 130 can push inner sleeve 134 from the first inner sleeve position to the second inner sleeve position. As inner sleeve 134 shifts, a gap opens or widens between the upper face of inner sleeve 134 and the lower face of spacer 132 (or other shoulder or feature) to create seat expansion area 136 into which seat ring 130 can expand.

In one embodiment, seat ring 130 may be sized such that it is in a compressed state when retained in the seat retaining area and is biased radially outward so that it naturally expands outward when it reaches seat expansion area 136. In another embodiment, seat ring 130 may be sized to fit within the seat retaining area without being compressed. When seat ring 130 is in the seat expansion area, the activation device may force seat ring 130 to expand, allowing the activation device to move past seat ring 130.

The releasable setting mechanism that holds seat ring 130 relative to shift sleeve 120 (e.g., shear pins 138) can be selected such that it releases at a higher pressure than the releasable setting mechanism that holds shift sleeve 120 relative to valve housing 112 (e.g., shear pins 140).

To open the valve 110, a ball or other activation device may be introduced into the valve 110. The activation device may have an external diameter larger than that of the internal diameter of seat ring 130 when seat ring 130 is in an unexpanded or constricted configuration. Thus, the activation device may travel down bore 107 until it rests on the seat ring 130. The activation device resting on seat ring 130 provides a restriction such that pressure may accumulate upwell of the activation device, creating a pressure differential between the upwell and downwell sides of the activation device. When a first threshold pressure differential is achieved, shear pins 140 or other releasable setting mechanism will release allowing shift sleeve 120 to shift to an open position.

The seat releasable engagement mechanism can be configured not to release at this point. For example, shear pins 138 may be selected to provide a higher holding force than shear pins 140. However, because the activation device is seated above openings 114, 122 pressure can continue to build above the activation device. When a second threshold pressure differential is achieved, shear pins 138 or other setting mechanism will release so that seat ring 130 can shift relative to shift sleeve 120 and expand into expansion area 136. With seat ring 130 in the expanded configuration, the activation device may pass through seat ring 130 and continue downwell, exiting valve 110.

Shift sleeve 120 further includes a first shift profile 142 and a second shift profile 144 at each end. The shift profiles 142, 144 can be selected to be compatible with a shifting tool. The shifting tool may be used to locate sleeve 120 and pull sleeve 120 back to the first position to reclose valve 110 or to push sleeve to the second position to reopen valve 110.

One or more releasable engagement mechanisms may be provided to prevent sleeve 120 from reopening or reclosing inadvertently. Dogs, a load ring, detents, a c-ring, collet or other releasable engagement mechanisms may be employed. According to one embodiment, the upper end of shift sleeve comprises a collet 148 that is biased radially outward. When shift sleeve 120 is in the closed position, projections on the outer surface of collet 148 may align with and partially extend into an upper collet groove 150 on the inner surface of sleeve retaining area and when shift sleeve 120 is in the open position, the collet projections may align with and partially extend into a lower collet groove 152 on the inner surface of the sleeve retaining area. The collet or other releasable engagement mechanism can be configured such that the holding force of the releasable engagement mechanism can be overcome through manipulation of shift sleeve 120 by the shifting tool. Sleeve 120 may be shifted as many times as desired to open and close the valve.

One or more seals (e.g., seals 154, 156, 158) may be provided to deter fluid leakage to/from inner bore 107 between the surface of the sleeve retaining area and the outer surface of sleeve 120. In the arrangement illustrated, seals 154 and 156 straddle openings 122 and deter leakage at openings 122 when sleeve 120 is in a closed position. Seal 158 can be provided to deter steam from leaking back up between sleeve 120 and housing 112. It will be appreciated that annularly extending seals may be particularly useful. Seals 154, 156 and 158 may take various forms and be formed of various materials, such as, for example, various combinations of elastomerics, thermoplastics, metals, rings, O-rings, chevron or v-seal stacks, wiper seals, etc. If any seals must pass over contoured surfaces such as ports or glands, but still work in a sealing capacity consideration may be given to the form and durability of the seal. For example, seal 156 may pass over valve openings 114, which may have sharp edges, yet continue to be required to act in a sealing capacity. Seal 156 may, in one embodiment, therefore be bonded in its gland, such that it cannot easily be pulled or dislodged therefrom. Alternately or in addition, seal 156 may be selected to include a stack of chevron seals, the seals being formed each with a V-shaped cross section, as these seals may have a resistance to dislodging from their glands and resistance to damage greater than those of O-rings. In some embodiments, the seals may be formed with high-durability polymers, such as elastomers for example, EPDM, FFKM, and FEPM, etc., and thermoplastics, such as PAEK.

Steam diversion assembly 100 comprises a flow control assembly 160 configured to redirect steam exiting openings 114 and create a desired pressure drop. A tubular retainer 162 is placed around a portion of the body 106 to overlap openings 114. Retainer 162 is offset from the body 106 by a plurality of spacer members 164 such that insert retaining areas are formed between retainer 162 and body 106. Inserts 170 are disposed in the insert retaining areas and define one or more steam diversion channels 175 configured to divert steam longitudinally from one or more steam inlets 180 to one or more steam outlets 182 used for fluid communication to the surrounding wellbore.

When steam diversion assembly 100 is in a valve open configuration, a portion of the steam pumped down the injection string is directed into the surrounding wellbore through flow control assembly 160. This portion flows from the bore 107, though sleeve openings 122, valve openings 114 and insert steam inlets 180 into inserts 170. Inserts 170 direct the steam to the steam outlets 182 via steam diversion channels 175. A portion of the steam may also flow through steam diversion assembly 100 from end to end.

Flow control assembly 160 may be used to control the direction, pressure drop, etc. of steam exiting the valve through flow control assembly 160. Preferably, flow control assembly 160 redirects steam so that the steam exits flow control assembly 160 substantially longitudinally with a desired pressure drop. The steam outlets 182 can be configured so that the steam is not injected straight out. For example, the outlet ports may have an exit plane with a normal vector parallel to or a desired angle from the longitudinal axis of the valve to facilitate directing steam in a desired direction.

Figure 3A:
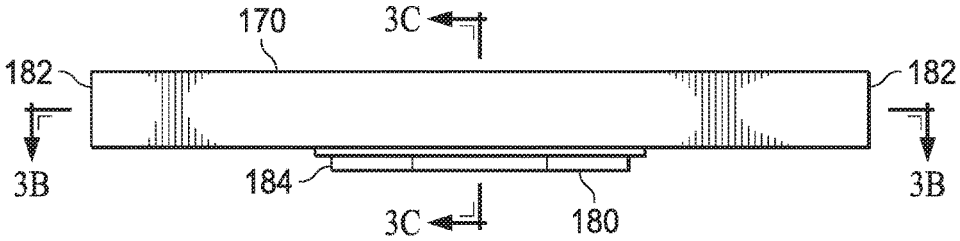
FIG. 3A illustrates a first view of one embodiment of a flow control assembly insert.
Figure 3B:
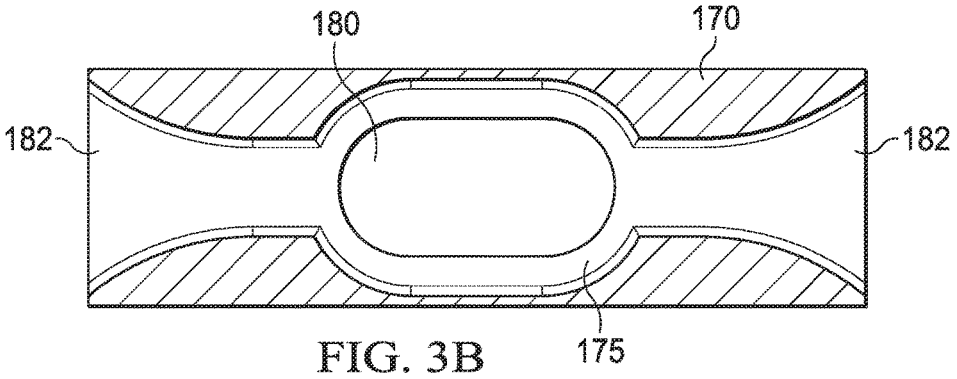
FIG. 3B illustrates a first example cross-sectional view of the insert of FIG. 3A.
Figure 3C:
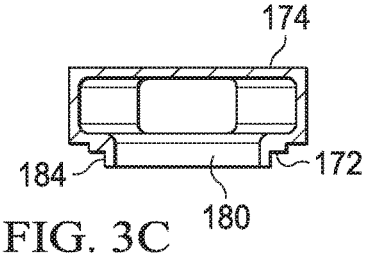
FIG. 3C illustrates a second example cross-sectional view of the insert of FIG. 3A.

FIG. 3A, FIG. 3B and FIG. 3C (collectively FIG. 3) illustrate one embodiment of an insert 170. In the embodiment illustrated, insert 170 includes a radially inner wall 172 (wall proximate to valve housing 112 when insert 170 is installed), radially outer wall 174 and sidewalls extending between the radially inner wall 172 and radially outer wall 174. Insert 170 defines a steam diversion channel 175 from a steam inlet 180 through inner wall 172 to steam outlets 182 that are longitudinally displaced from the steam inlet 180. Steam diversion channel 175 may be configured to produce a desired pressure drop. In the embodiment illustrated in FIG. 3B, the steam diversion channel is shaped to create nozzles at the outlets. It can be noted that the exit aperture of the nozzles has a rectangular cross-section when viewed from the ends as illustrated in FIG. 3C. Other channel profiles may also be selected.

According to one embodiment, insert 170 is formed of an erosion resistant material—a material that is harder than the metals used to form valve housing 112, sleeve 120 or retainer 162—such that the pressure drop from the inlet 180 to the outlet 182 is contained in a flow path fully defined by the erosion resistant materials. That is, according to one embodiment, all surfaces that the steam will contact in the flow control assembly 160 are erosion resistant. For example, the entire steam flow channels in steam flow control assembly 160 may formed by or coated with an erosion resistant material such as ceramic, tungsten carbide, hard metal or other material. In some embodiments, the erosion resistant material may be a heat treated material.

While insert 170 of FIG. 3 is open at both ends, in other embodiments, insert 170 may only be open at one end or, in the case of a blank insert, neither end. The configuration of inserts included in a steam diversion assembly 100 can be selected to achieve a desired overall pressure drop. A particular steam diversion assembly 100 may have a single type of insert or a mix of insert types. Furthermore, inserts 170 may accommodate various size flow restrictors, examples of which are described in conjunction with FIG. 7.

Selected inserts 170 can be placed in the insert retaining areas during assembly. Alignment features may be provided to help align inserts 170 with openings 114. For example, in the embodiment of FIG. 3C, an inlet wall 184 surrounding inlet 180 extends radially inward from the inner surface of inner wall 172 and is configured to fit in a valve opening 114 with the adjacent surfaces of inlet wall 184 and the valve opening 114 in contact with each other as illustrated in FIG. 2E. In addition to aiding in alignment, wall 184 can help protect the corners from erosion. In any event, with the selected inserts 170 in place, retainer 162 may be coupled to body 106 though heat shrinking or other procedure.

Returning briefly to FIG. 2, the seat ring 130 is upwell of the valve openings 114 and the sleeve openings 122 are also upwell of the valve openings 114. In this arrangement, the valve openings 114 may be downwell from the activation device and seat ring when the valve is initially opened and thus the steam upwell of the activation device may not be exposed to the valve opening 114 until the activation device has passed through the seat ring 130.

Figure 8A:
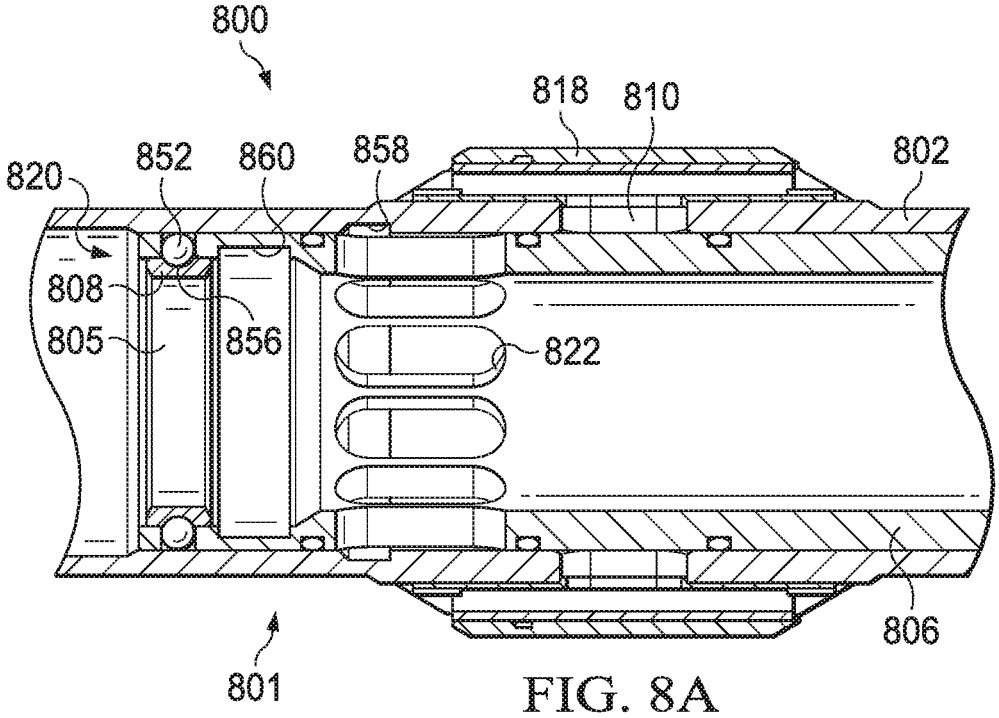
FIG. 8A illustrates another embodiment of a steam diversion assembly in a closed configuration.
Figure 8B:
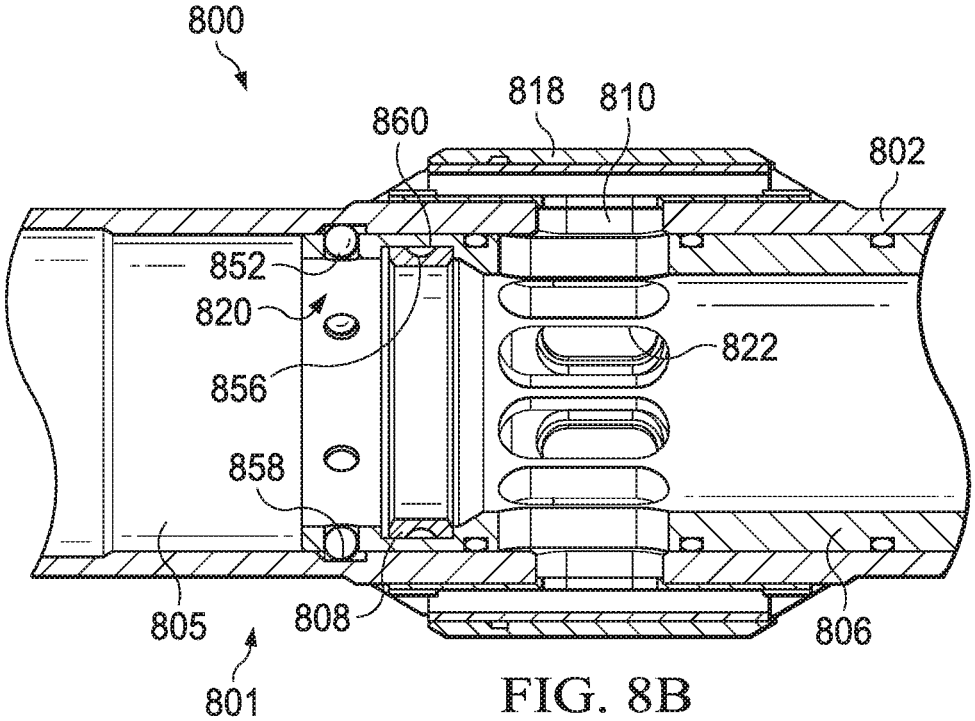
FIG. 8B illustrates the embodiment of FIG. 8A in an open configuration.

FIG. 8A and FIG. 8B (collectively FIG. 8) illustrate another embodiment of a steam diversion assembly 800 in which an expandable seat is located above the valve openings. Steam diversion assembly 800 may include one or more tubulars that form a body with a bore 805 there through. The tubulars may include a valve housing 802 having one or more openings 810 through the outer wall of housing 802. A shift sleeve 806 is movable in the housing 812 to selectively cover the openings 810 or expose the openings to the inner bore of the valve, thereby opening and closing the valve. When valve 801 is in a closed position, steam flows through bore 805 from one end of the steam diversion assembly body to the other end. Openings 810 provide fluid communication between bore 805 and flow control assembly 818. When valve 801 is in an open position, steam can flow through valve openings 810 and into flow control assembly 818, which can provide fluid communication from bore 805 to the surrounding wellbore. Flow control assembly 818 may be similar to flow control assemblies 160 or 318 or have another configuration.

Shift sleeve 806 may operate similarly to shift sleeve 120. Shift sleeve 806 is selectively movable between a first position and a second position within the housing 802. Shift sleeve 806 includes a plurality of sleeve openings 822 that are configured to act as a fluid passageway when the steam diversion assembly 800 is in the open position. In the embodiment illustrated, sleeve openings 822 are spaced and positioned such that sleeve openings 822 align with or at least partially overlap valve openings 810 when sleeve 806 is in a valve open position. The shift sleeve 806 in the first position is shown in FIG. 8A and corresponds to the steam diversion assembly 800 in the closed position. Shift sleeve 806 in the second position is shown in FIG. 8B and corresponds to the steam diversion assembly 800 in the opened position.

In FIG. 8A, seat ring 808 is fit, in an unexpanded configuration, into the seat retaining area 820 (see FIG. 8B) proximate to the upper end of sleeve 806. Seat ring 808 may be held in place in the seat retaining area 820 by a releasable engagement feature. According to one embodiment, the releasable engagement features includes one or more releasable inward protrusions that extend through one or more openings in the inner surface of sleeve 806. The inward protrusions may comprise any suitable protrusions, including, but not limited to dogs, spring loaded pins, clips, an expandable c-ring or other protrusion. In the embodiment illustrated, the inward protrusions are provided by load bearing balls 852. In some embodiments, load bearing balls 852 or other protrusions are coupled to or abut a ball retainer (e.g., c-ring, split ring). The balls 852 partially project through openings in the inner surface of the seat retaining area 820.

In FIG. 8A, the inward protrusions are partially received in one or more recesses in the outer surface of seat ring 808. For example, seat ring 808 may include groove 856 to partially receive load bearing balls 852 when seat ring 808 is seated in seat retaining area 820. Load bearing balls 852 may be held in groove 856 (or other feature) on the outer surface of seat ring 808 by the inside diameter of a ball retainer or the inner surface of housing 802. The load bearing balls 852 and side of groove 856 create interference so that, when load bearing balls 852 are in an engaged position, seat ring 808 cannot translate relative to sleeve 806. The force required to overcome the holding force of load bearing balls 852 in groove 856 can be greater than the force required to overcome a releasable setting mechanism (e.g., shear pins, c-ring, or other releasable setting mechanism) (not illustrated) that initially prevents sleeve 806 from shifting relative to housing 802. In other words, when sufficient force is applied to initially shift sleeve 806 (e.g., when a sufficient differential pressure is established across an activation device seated in seat ring 808) seat ring 808 and sleeve 806 shift together.

Seat ring 808 may remain retained seat retaining area 820 by the releasable engagement mechanism until sleeve 806 has been shifted to an open position by an activation device. When sleeve 806 reaches the open position (or other desired position) the releasable engagement mechanism can release seat ring 808. According to one embodiment, load bearing balls 852 (or other protrusions) reach a position where outward expansion is not restricted by housing 802 and seat ring 808 is released. As shown in FIG. 8B, for example, the load bearing balls 852 move with sleeve 806 until they reach a position where they overlap and can expand radially into recess 858 in the inner surface of housing 802 (or other portion of valve 801) allowing load bearing balls 852 to retract. The inside diameter of recess 858 may be chosen such that the inward protrusions may move outward from the centerline of sleeve 806 a sufficient distance such that the inward protrusions no longer prevent translation of seat ring 808 relative to sleeve 806.

Accordingly, as illustrated in FIG. 8B, seat ring 808 may move from the seat retaining area 820 of sleeve 806 into a seat expansion area 860. Seat expansion area 860 has a larger inner diameter than the inner diameter of seat retaining area 820 such that seat ring 808 may expand to have a larger inner diameter. This larger inner diameter of seat ring 808 may be equal to or larger than that of the activation device (not shown) used to shift sleeve 806, thus allowing the activation device to pass through seat ring 808.

In one embodiment, seat ring 808 may be sized such that it is in a compressed state when retained in shift sleeve 806 and naturally expands upon entering the seat expansion area 860. In another embodiment, seat ring 808 may be sized to fit within the sleeve without being compressed. When seat ring 808 is in the seat expansion area 860, the activation device may force seat ring 808 to expand, allowing the activation device to move past seat ring 808.

While the releasable engagement mechanism in FIGS. 8A and 8B comprises load bearing balls in a groove, many other possible release mechanisms may be used. By way of example, but not limitation, inward protrusions can be provided by balls, dogs or other features that can expand outwards, shear pins, split rings, clips etc. One of ordinary skill in the art will appreciate that many different expandable seats can be used actuate an activation device-shiftable valve.

Figure 4:
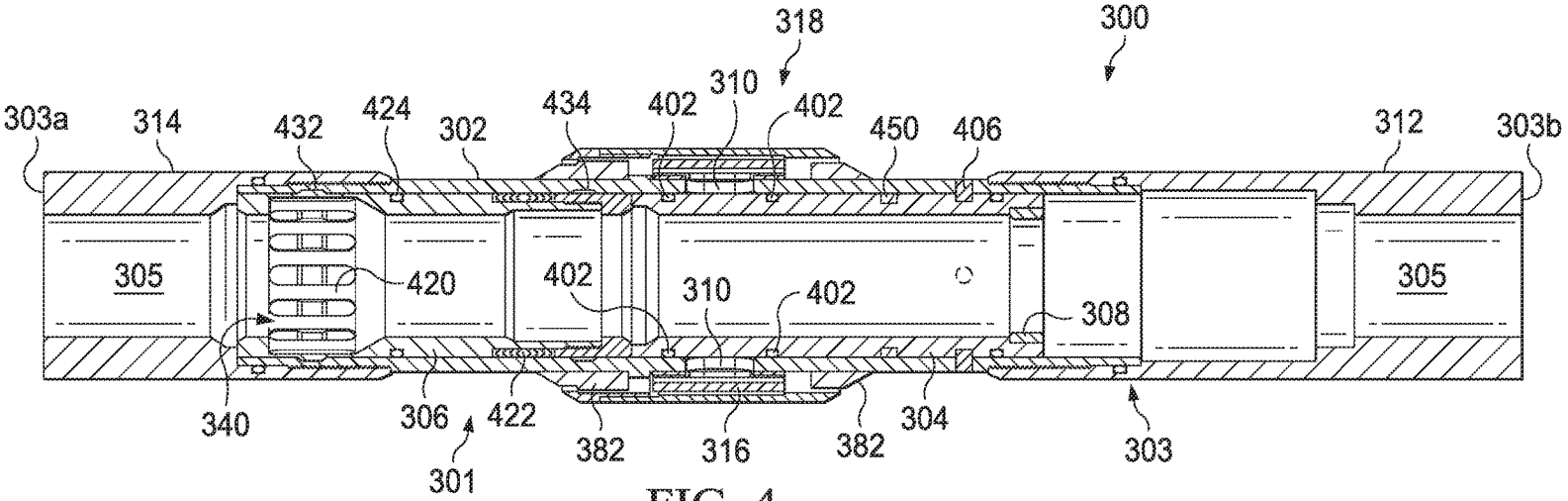
FIG. 4 is a cutaway view of another embodiment of a steam diversion assembly.
Figure 5A:
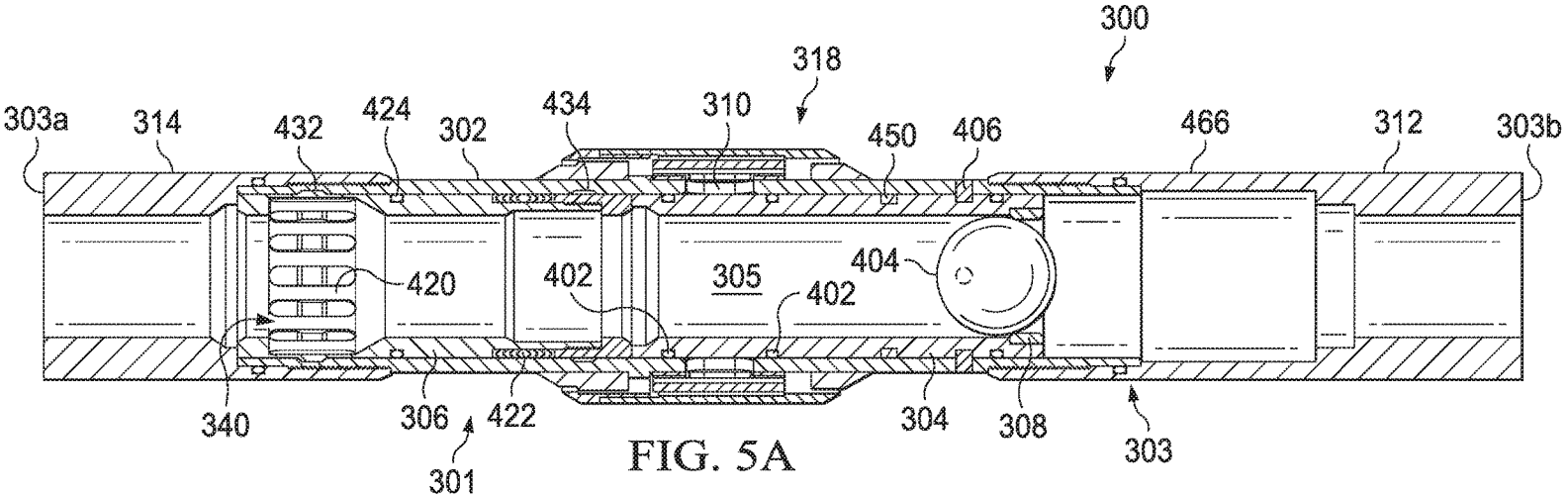
FIG. 5A is a diagrammatic representation of the embodiment of FIG. 4 in a first configuration.
Figure 5B:
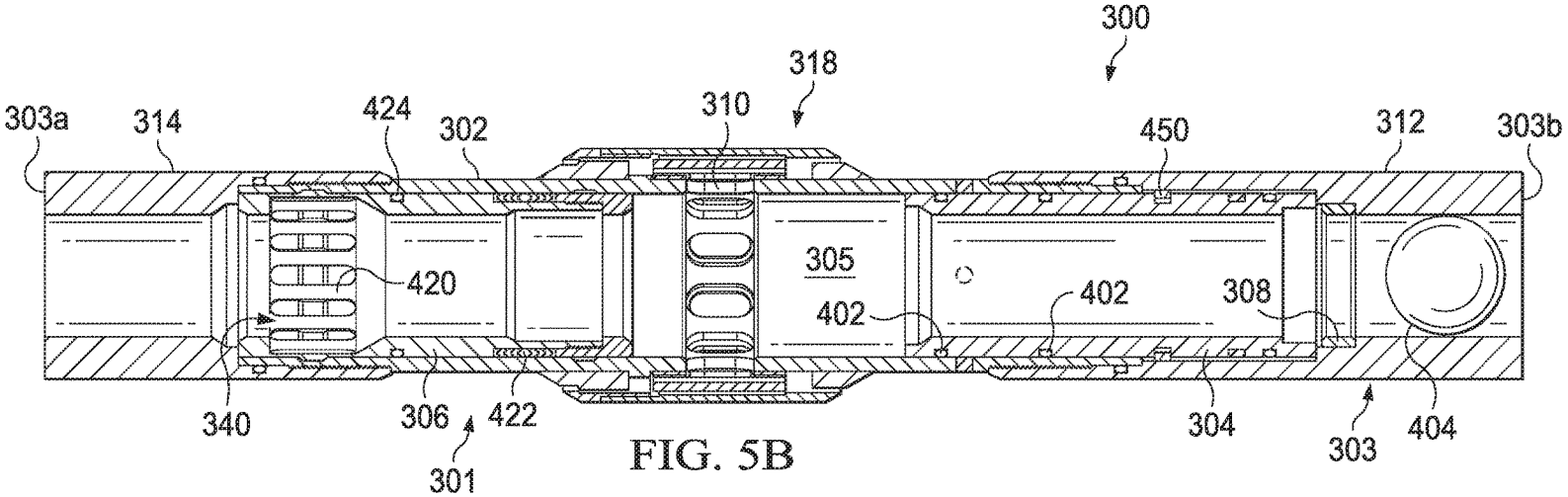
FIG. 5B is a diagrammatic representation of the embodiment of FIG. 4 in a second configuration.
Figure 5C:
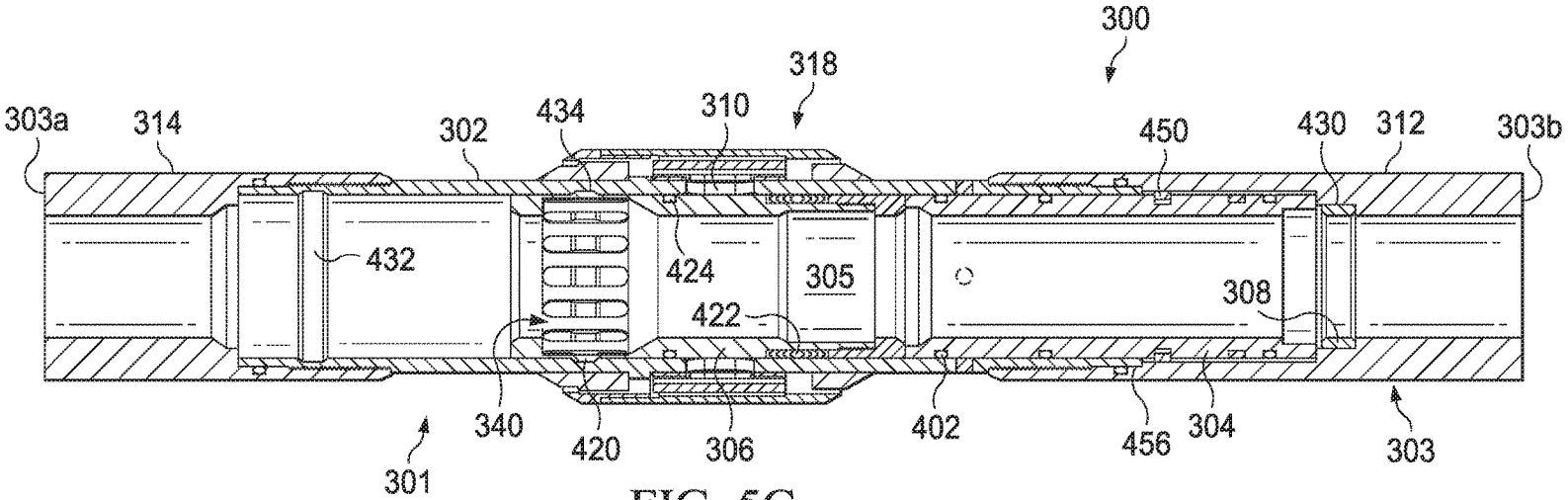
FIG. 5C is a diagrammatic representation of the embodiment of FIG. 4 in a third configuration.

FIG. 4 is a diagrammatic representation of another embodiment of a steam diversion assembly 300 for use in wellbore operations including, but not limited to, SAGD operations. In the embodiment of FIG. 4, the activation device seat is located below the valve openings. Steam diversion assembly 300 may be used, for example, as a steam diversion assembly in a steam injection string (e.g., as a steam diversion assembly 20 of FIG. 1). FIGS. 5A-5C show one embodiment of steam diversion assembly 300 in various open/closed positions. FIG. 5A illustrates steam diversion assembly 300 in a closed (run in) configuration, FIG. 5B illustrates steam diversion assembly 300 in a valve open configuration, and FIG. 5C illustrates steam diversion assembly 300 in a valve re-closed configuration.

Steam diversion assembly 300 comprises a valve 301, flow control assembly 318, upper connection tubular 314 and lower connection tubular 312. Valve 301 comprises a housing 302 having one or more openings 310 through the outer wall of housing 302. Upper connection tubular 314, lower connection tubular 312 and valve housing 302 form a tubular body 303 having a bore 305 extending from a first end 303*a* to a second end 303*b*. A lower sleeve 304 and upper sleeve 306 are movable in the housing 302 to selectively cover the openings 310 or expose the openings to the inner bore 305 of the valve, thereby opening and closing the valve. Lower connection tubular 312 and upper connection tubular 314 may be used to retain lower sleeve 304 and upper sleeve 306 in housing 302. Openings 310 provide fluid communication between bore 305 and flow control assembly 318. When valve 301 is in a closed position, steam flows through bore 305 from one end of body 303 to the other end. When valve 301 is in an open position, steam can flow through valve openings 310 and into flow control assembly 318, which can provide fluid communication from bore 305 to the surrounding wellbore.

In FIG. 4 and FIG. 5A, both lower sleeve 304 and upper sleeve 306 are in the upper position. One or more releasable setting mechanisms, such as one or more of a shear pin, a collet, a c-ring, or other releasable setting device, may be provided to releasably hold lower sleeve 304 in an upper position until the holding force of the releasable setting device is overcome. In the illustrated embodiment, shear pins 406 are provided to maintain sleeve 304 in the closed position. In this position, lower sleeve 304 covers the inner side of openings 310 and the valve is closed. Seals 402 between the outer surface of lower sleeve 304 and inner surface of housing 302 further prevent fluid transfer through openings 310. Shear pins 406 can shear when a sufficient differential pressure is established across the seat ring 308 thereby allowing sleeve 304 to shift to an open position.

One or more secondary locking mechanisms may be provided to prevent sleeve 304 from inadvertently closing once open. Dogs, a load ring, detents, a c-spring, collet or other locking mechanisms may be employed. The locking mechanism may be variously configured, such as in the form of a c-ring set in a groove, such as a gland, and normally biased outwardly but locked between the sleeve 304 and housing 302. In the embodiment illustrated, the secondary locking mechanism is provided by a c-ring 450 disposed in a groove on the outer surface of sleeve 304. In a port open position, the c-ring 450 may align with and partially extend into an expansion area 466 on the inner surface of the sleeve retaining area. In its expanded configuration, c-ring 450 may cooperate with a stop, such as shoulder 456 (FIG. 5C), to prevent lower sleeve 304 closing.

One or more releasable engagement mechanisms may be provided to prevent upper sleeve 306 from shifting down with lower sleeve 304. Dogs, a load ring, detents, a c-ring, collet or other releasable engagement mechanisms may be employed. According to one embodiment, the upper end of shift sleeve comprises a collet 420 that is biased radially outward. When upper sleeve 306 is in its upper position, the collet 420 is positioned to push collet extensions into a corresponding upper collet groove 432 on the inner surface of the sleeve retaining area. When upper sleeve 306 is in its lower position, the collet 420 is positioned to push the collet extensions into lower collet groove 434. The collet or other releasable engagement mechanism can be configured such that the holding force of the releasable engagement mechanism can be overcome through manipulation of sleeve 306 by the shifting tool.

Lower sleeve 304 may include an expandable activation device seat on which an activation device, such as ball, dart or other activation device conveyed down the injection string, can land. The activation device can create a sufficient seal with the seat or other portion of steam diversion assembly 300 such that pressure can be applied through the tubing string from the surface to create a pressure differential across the seat. The pressure differential drives sleeve 304 toward the low pressure side, opening valve 301.

In one embodiment, the expandable seat comprises an expandable seat ring 308 (e.g., a split ring, c-ring or other ring that can expand in diameter) that is removably coupled to lower sleeve 304. In the configuration illustrated, seat ring 308 is retained in a seat retaining area of sleeve 304 by a releasable engagement mechanism (one embodiment of which is discussed in conjunction with FIG. 6). Seat ring 308 may be expandable such that, in a first seat configuration, the inner diameter of seat ring 308 is smaller than the diameter of an activation device and, in a second seat configuration, the diameter of seat ring 308 is the same diameter or larger than the diameter of the activation device that activated valve 301.

To shift the valve 301, a ball 404 (FIG. 5A) (or other activation device) may be introduced into the valve 301. Ball 404 may have an external diameter larger than that of the internal diameter of seat ring 308 when seat ring 308 is in an unexpanded configuration. Thus, ball 404 may travel down the valve 301 until it rests on seat ring 308, as shown in FIG. 5A. Ball 404 resting on seat ring 308 provides a restriction such that pressure may accumulate upwell of ball 404, creating a pressure differential between the upwell and downwell sides of ball 404. This pressure differential applies a force on ball 404, which drives seat ring 308 to the lower pressure side.

Seat ring 308 can be coupled to lower sleeve 304 by a releasable engagement mechanism such that the force on seat ring 308 is transmitted to lower sleeve 304. Once sufficient force is reached by the pressure differential on ball 404, the releasable setting device (e.g., a shear pin 406 or other releasable setting device) releases to allow lower sleeve 304 to shift to a position that exposes openings 310 to the bore 305 of valve 301, as shown in FIG. 5B. Because, in this configuration, a releasable engagement device (e.g., collet 420 or other releasable engagement device) maintains upper sleeve 306 in the upwell position, moving lower sleeve 304 to an open position uncovers openings 310, allowing access from the central bore 305 of valve 301. In this configuration, valve 301 is considered open.

The expandable seat can be configured to expand to allow ball 404 to pass. With reference to FIG. 5B, when lower sleeve 304 reaches a lower position, the releasable engagement mechanism releases seat ring 308 from a seat retaining area in lower sleeve 304. Ball 404 can push seat ring 308 out of the seat retaining area of lower sleeve 304 and into a seat expansion area 430 (FIG. 5B) having a greater inner diameter than the seat retaining area of lower sleeve 304. Seat ring 308 may be biased radially outward so that it expands outward when it reaches the area of larger diameter. Seat ring 308 may thus be allowed to expand such that ball 404 may pass through seat ring 308. Ball 404 may continue downwell, exiting the valve 301. While seat expansion area 430, in the embodiment illustrated, is defined in lower connection tubular 312, in other embodiments, seat expansion area 430 can be defined in housing 302, sleeve 304 or other desirable location.

After the valve has been opened by shifting lower sleeve 304 downwell, the valve may be reclosed by moving upper sleeve 306 downwell as shown in FIG. 5C. Upper sleeve 306 may contain features (such as the illustrated shift profiles 340 or other features) that allow a tool such as an OTIS 'B' Shifting Tool to locate upper sleeve 306 and shift upper sleeve 306. With upper sleeve 306 shifted downwell, upper sleeve 306 covers openings 310 in housing 302, thus closing the valve. The releasable setting device (e.g., collet 420 or other releasable setting device) can maintain upper sleeve 306 in a closed position. For example, when upper sleeve 306 is in its upper position, the collet 420 can be positioned to push collet extensions into a corresponding lower groove 434 on the inner surface of the sleeve retaining area.

Upper sleeve may be shifted as many times as desired to open and close the valve. One or more seals 422, 424 may be used to help seal openings 310. According to one embodiment, seal 422 may be configured so that it can pass over openings 310 multiple times without degrading. In some embodiments, upper sleeve 306 may also be moved back to an open position through the use of a shifting tool allowing valve 301 to be opened and closed multiple times.

Returning to FIG. 4, steam diversion assembly 300 may also comprise a flow control assembly 318 configured to redirect steam exiting openings 310 in an axial direction and to create a desired pressure drop. Steam diversion channels 316 located within flow control assembly 318 include one or more steam inlets that overlap openings 310 and one or more steam outlets that are longitudinally displaced from the steam inlets and shaped to direct steam substantially longitudinally. The steam outlets are used for fluid communication to the surrounding wellbore. Steam diversion channels 316 may be configured to produce a desired pressure drop. The pressure drop may be contained in a flow path defined by erosion resistant materials. These and other aspects of one embodiment of flow control assembly 318 are discussed in conjunction with FIG. 7 below.

Figure 6A:
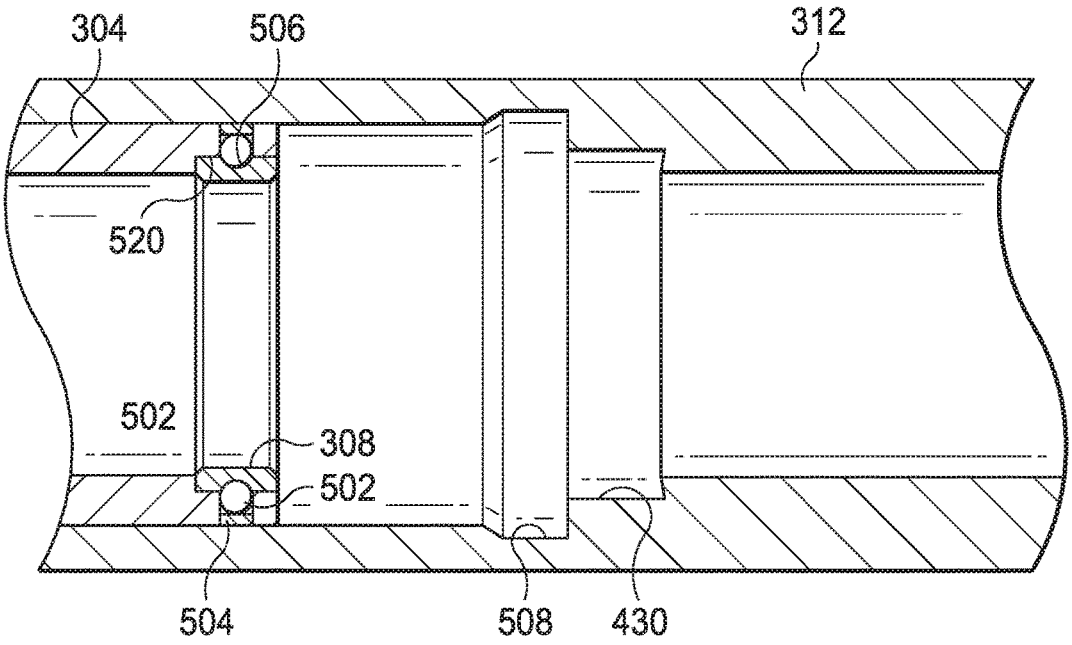
FIG. 6A is a detail view of one embodiment a seat release mechanism in a first configuration.
Figure 6B:
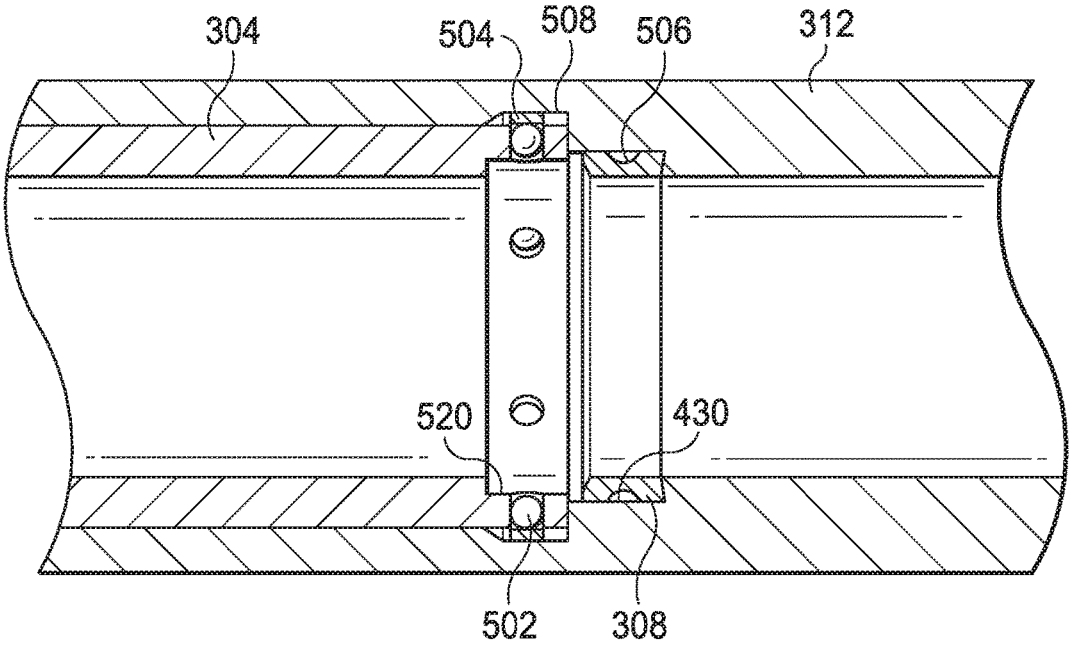
FIG. 6B is a detail view of the embodiment of FIG. 6A in a second configuration.

FIGS. 6A-6B (collectively FIG. 6) show a cutaway view of one embodiment of an expandable seat and releasable engagement mechanism in more detail. In FIG. 6A, seat ring 308 is fit into the seat retaining area 520 of lower sleeve 304 in an unexpanded configuration. Seat ring 308 may be held in place in the seat retaining area 520 by a releasable engagement feature. According to one embodiment, the releasable engagement features includes one or more releasable inward protrusions that extend through one or more openings in the inner surface of sleeve 304. The inward protrusions may comprise any suitable protrusions, including, but not limited to dogs, spring loaded pins, clips, an expandable c-ring or other protrusion. In the embodiment illustrated, the inward protrusions are provided by load bearing balls 502 that are coupled to or abut a ball retainer 504 (e.g., c-ring, split ring). The balls 502 partially project through openings in the inner surface of the seat retaining area. The openings may be smaller in diameter than load bearing balls 502 to form retention shoulders (e.g., retention shoulder 512 illustrated in FIG. 6B) to prevent load bearing balls 502 from falling through.

In FIG. 6A, the inward protrusions are partially received in one or more recesses in the outer surface of seat ring 308. For example, seat ring 308 may include groove 506 to partially receive load bearing balls 502 when seat ring 308 is seated in lower sleeve 304. Load bearing balls 502 may be held in groove 506 (or other feature) on the outer surface of seat ring 308 by the inside diameter of ball retainer 504. The load bearing balls 502 and side of groove 506 create interference so that, when load bearing balls 502 are in an engaged position, seat ring 308 cannot translate relative to sleeve 304. In other words, seat ring 308 and sleeve 304 will shift together.

Seat ring 308 may remain retained in lower sleeve 304 by the releasable engagement mechanism until lower sleeve 304 has been shifted to an open position by ball 404. When lower sleeve 304 reaches the open position (or other desired position) the releasable engagement mechanism releases seat ring 308. According to one embodiment, ball retainer 504 reaches a position where outward expansion is not restricted by housing 302 and/or lower connection tubular 312. In the example of FIG. 6B, ball retainer 504 moves with sleeve 304 until it reaches a position where it overlaps and can expand radially into recess 508 in the inner surface of lower connection tubular 312 (or other portion of valve 301) allowing the inward protrusions (e.g., load bearing balls 502) to retract. The inside diameter of recess 508 may be chosen such that ball retainer 504 and load bearing balls 502 may move outward from the centerline of lower sleeve 304 a sufficient distance such that load bearing balls 502 no longer prevent translation of seat ring 308 relative to lower sleeve 304.

Accordingly, as illustrated in FIG. 6B, seat ring 308 may move from the seat retaining area 520 of lower sleeve 304 into a seat expansion area 430. Seat expansion area 430 has a larger inner diameter than the inner diameter of the seat retaining area of lower sleeve 304 such that seat ring 308 may expand to have a larger inner diameter. This larger inner diameter of seat ring 308 may be equal to or larger than ball 404 (not shown) used to shift lower sleeve 304, thus allowing ball 404 to pass through seat ring 308. While seat expansion area 430 is illustrated as being defined on the inner surface of the lower connection, the seat expansion area may be defined at any suitable location including within sleeve 304.

In one embodiment, seat ring 308 may be sized such that it is in a compressed state when retained in lower sleeve 304 and naturally expands upon entering the seat expansion area 430. In another embodiment, seat ring 308 may be sized to fit within the sleeve without being compressed. When seat ring 308 is in the seat expansion area 430, ball 404 may force seat ring 308 to expand, allowing ball 404 to move past seat ring 308.

While in FIGS. 6A and 6B the releasable engagement mechanism comprises load bearing balls in a groove, many other possible release mechanisms may be used. By way of example, but not limitation, inward protrusions can be provided by balls, dogs or other features that can expand outwards, shear pins, split rings, clips etc. One of ordinary skill in the art will appreciate that many different expandable plug seats can be used actuate a plug-shiftable valve.

With valve 301 in the open position, steam or other fluid may be free to pass out of the valve through openings 310. Steam may then enter a steam diversion channels 316 (FIG. 4) contained within a flow control assembly 318. Thus, a portion of the steam is directed into the surrounding wellbore through flow control assembly 318, and another portion of the steam moves through steam diversion assembly 300 from end to end. Flow control assembly 318 may be used to control the direction, pressure drop, etc. of steam exiting the valve through flow control assembly 318.

Preferably, flow control assembly 318 redirects steam so that the steam exits flow control assembly 318 substantially longitudinally with a desired pressure drop. Steam enters the steam flow control assembly through steam inlets (e.g., tray openings 680 of FIG. 7) that overlap opening 310 through the outer wall of housing 302. Steam is directed to one or more steam outlets 382 (FIG. 4) by one or more steam diversion channels 316, where the steam outlets 382 are longitudinally displaced from the steam inlets. The steam outlets 382 are configured so that the steam is not injected straight out. The outlet ports may have an exit plane with a normal vector parallel to or a desired angle from the longitudinal axis of the valve.

The steam inlet(s), steam outlet(s) 382 and steam diversion channel(s) 316 can be configured to create a desired pressure drop. According to one embodiment, the entire steam diversion channels in steam flow control assembly 318 are formed by or coated with an erosion resistant material such as ceramic, tungsten carbide or other material. That is, according to one embodiment, all surfaces of flow control assembly 318 that the steam will contact in the steam flow channels are erosion resistant. Thus, the entire pressure drop from the steam inlets to the steam outlets is contained in an erosion resistant steam flow channel.

Figure 7A:
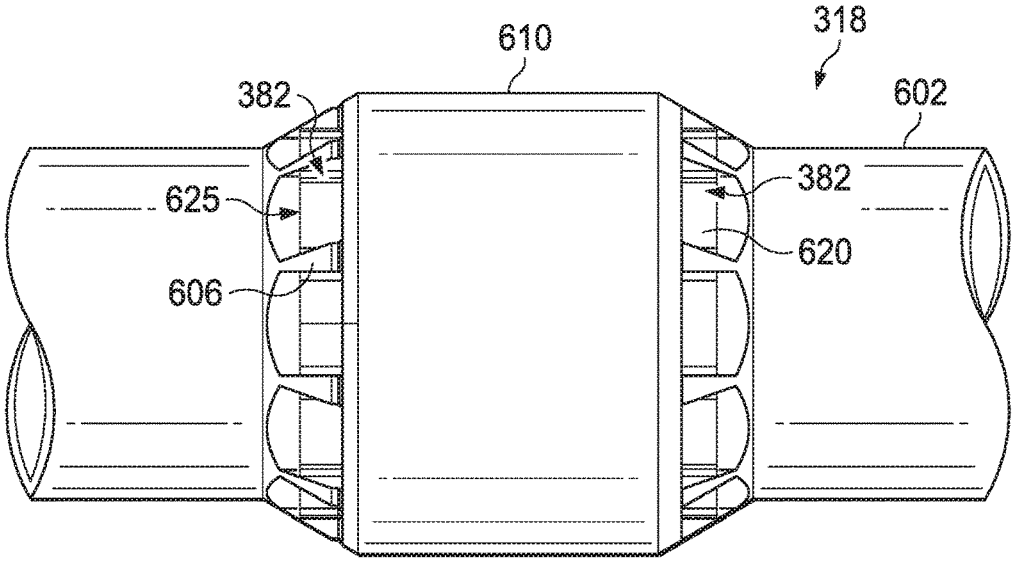
FIG. 7A is a diagrammatic representation of one embodiment of a flow control assembly.
Figure 7B:
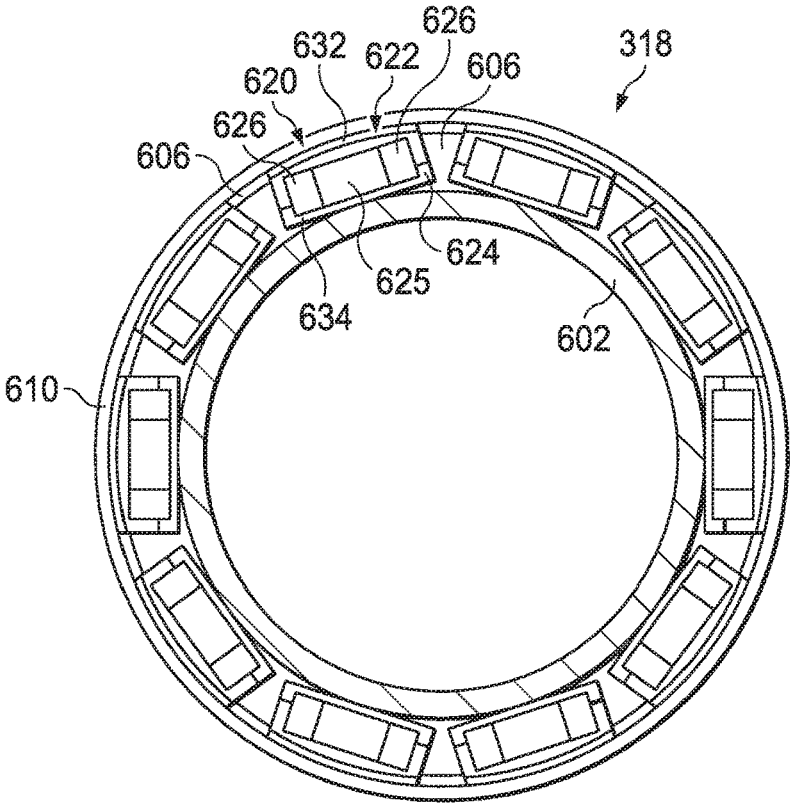
FIG. 7B is an example end view of the embodiment of FIG. 7A.
Figure 7C:
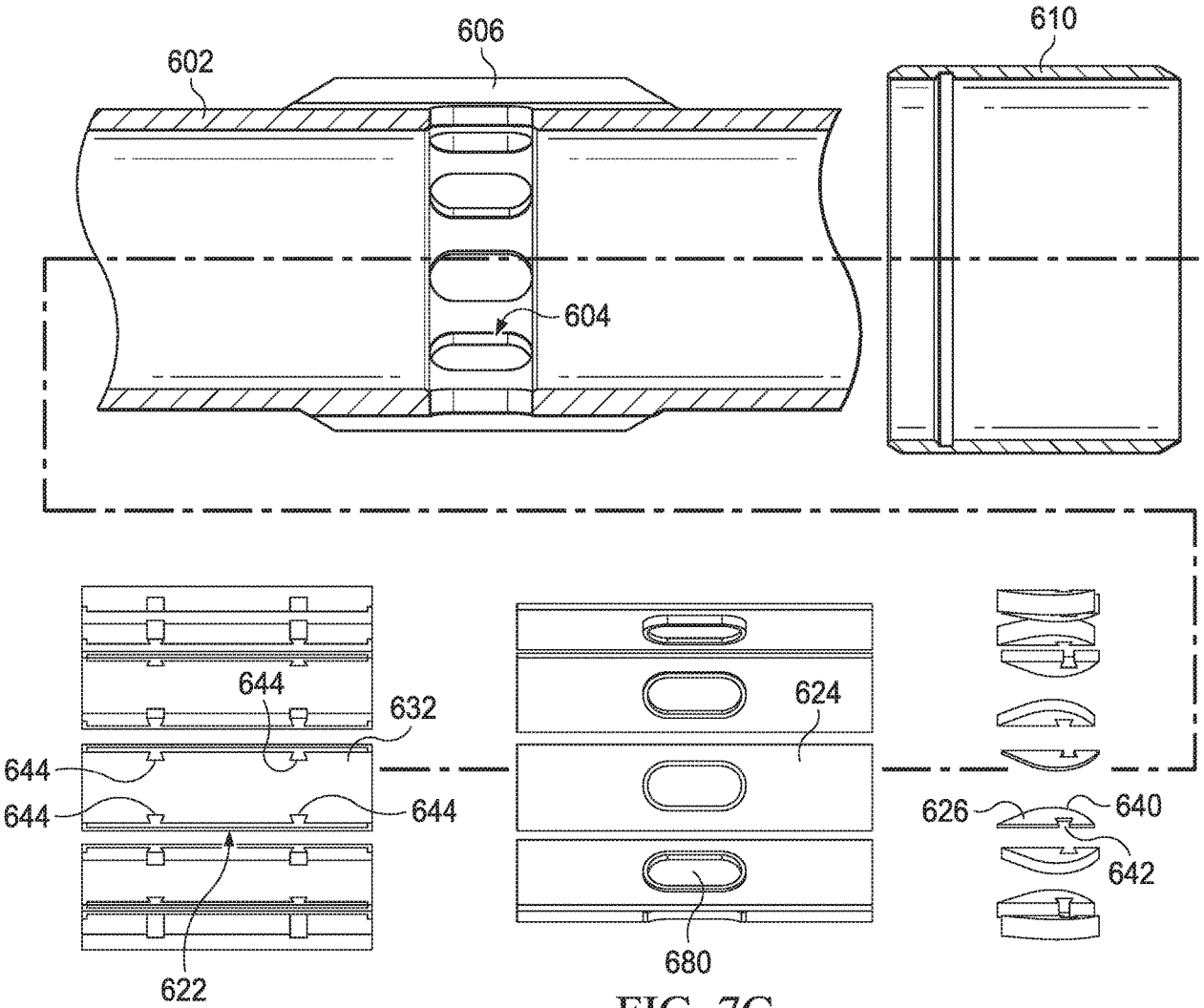
FIG. 7C is an example exploded view of the embodiment of FIG. 7A.

Flow control assembly 318 can have a variety of configurations. FIGS. 7A-7C (collectively FIG. 7) illustrates one embodiment of a flow control assembly 318. Flow control assembly 318 is configured to redirect steam exiting openings (e.g., opening 310 of FIG. 4) and create a desired pressure drop. Flow control assembly 318 comprises a base 602 that can be placed around a tubular body with base openings 604 aligned with openings in the tubular body. For example, base 602 can be placed about tubular body 303 of FIG. 4, with base openings 604 aligned with, or at least partially overlapping or otherwise in fluid communication with, valve openings 310.

A tubular retainer 610 is placed around a portion of the base 602 overlapping base openings 604. The retainer 610 is offset from the base 602 by a plurality of spacer members 606 such that insert retaining areas are formed between retainer 610 and base 602. Inserts 620 are disposed in the insert retaining areas and define one or more steam diversion channels 316 configured to divert steam longitudinally from one or more steam inlets (e.g., provided by tray openings 680 FIG. 7C) to one or more steam outlets 382 (FIG. 4 and FIG. 7A), which are used for fluid communication to the surrounding wellbore.

Inserts 620 may have varying size and/or geometry to control the direction and/or flow rate of steam through the flow control assembly 318. In one embodiment, various inserts may be provided that have different steam diversion channel flow path geometries to create a desired pressure drop. According to one embodiment, various flow paths may be accomplished by varying flow restrictors 626. Additionally, inserts 620 may have a restrictive geometry to cause a pressure drop of the fluid. The pressure drop of the fluid may take place fully within insert 620. According to one embodiment, inserts 620 are formed by or coated with an erosion resistant material such as ceramic, tungsten carbide or other material.

Each insert 620 may be comprised of one or more pieces. In the embodiment of FIG. 7C, each insert 620 may be comprised of cap 622, tray 624, and restrictors 626. Inserts 620 may be placed in grooves of base 602. Retainer 610 may then be placed over base 602 and inserts 620 to hold inserts 620 onto base 602 in the insert retaining areas. According to one embodiment, retainer 610 may be coupled to base 602 through heat shrinking or other mechanism.

Each tray 624 may contain a tray opening 680 to provide a steam inlet. Each tray opening 680 is positioned to at least partially overlap or otherwise be in fluid communication one of the base openings 604 in base 602. Flow control assembly 318 may be placed over housing 302 of steam valve 301 as shown in FIG. 4 such that openings 604 in base 602 of flow control assembly 318 may overlap openings 310 in housing 302, thus allowing fluid communication between the inside of housing 302 and inserts 620 when valve 301 is open. Accordingly, when valve 301 is in the open position (i.e. no sleeve is blocking openings 310, steam may travel from bore 305 and through valve openings 310, base openings 614 and tray openings 616 into the inserts 620. Steam diversion channels 316 divert the steam axially so that steam exits the flow control assembly 318 into the annulus from upwell end of inserts 620, the downwell end of inserts 620, or both.

In the embodiment of FIG. 7, a cap 622 and tray 624 can be assembled to create an insert 620 with a radially inner wall 632 (wall proximate to base 602 when insert 620 is installed), radially outer wall 634 and sidewalls extending between the radially inner wall 632 and radially outer wall 634.

Furthermore, one or more flow restrictors 626 may project laterally inward from the insert sidewalls to restrict or otherwise shape the steam diversion channels 316.

In the embodiment illustrated, each flow restrictor 626 includes a contoured laterally inner surface 640. The contoured surfaces 640 of flow restrictors 626 may have a variety of shapes to create desired flow passage shapes, including, for example, nozzle shapes. For example, multiple flow restrictors 626 can be installed in an insert 620 to create a steam diversion channel 316 shaped to have nozzles similar to those discussed above with respect to inserts 170.

Flow restrictors may 626 may be formed as part of cap 622, tray 624 or other component or may be coupled to the remainder of an insert 620 in any suitable manner, such as using fasteners, bonding or through other mechanism. In the illustrated embodiment, each flow restrictor 626 includes a laterally outer sidewall having a groove 642 that accepts a tongue 644 projecting from the inner surface of the insert sidewalls to create a tongue and groove connection, such as a dovetail connection, between the flow restrictor 626 and insert sidewall. As such, flow restrictors 626 can be attached to the insert sidewalls as part of the assembly process prior to cap 622 and tray 624 being assembled together.

In some embodiments, one side of an insert may be blocked (e.g., by a flow restrictor 626 that completely blocks the flow channel) such that steam only exits that insert from the upwell side or downwell side. Moreover, some inserts may be formed as blanks such that steam cannot flow from the inner bore 305 to the wellbore through that insert. Flow control assemblies 318 can be configured with various inserts to create a desired pressure drop.

Different steam diversion assemblies (e.g., steam diversion assemblies 100, 300, 800) in an injection string may have different combinations of inserts. For example, in order to evenly distribute the steam in the well, steam diversion assemblies near the bottom of the well may have use less restrictive inserts while steam diversion assemblies further upwell may use more restrictive inserts.

In operation, a well may contain several steam diversion assemblies, such as steam diversion assemblies 100, 300, 800, each requiring a different sized activation device to open. The steam diversion assemblies may be placed in the well such that the activation device size required to open the valve increases toward the top of the well. The smallest activation device may be conveyed down the string (e.g. dropped or pumped) and used to open the valve nearest the bottom of the well first. Successively larger activation devices may be dropped to open the remaining valves.

Components of the steam diversion assemblies may be made of any suitable material or combination of materials including, but not limited to, metals, including L-80 (NACE), steel, stainless steel, hardite or aluminum, tungsten carbide, ceramics, polymers, etc. Components may also be coated, such as with electroless nickel coating (ENC). Components may be partially or fully coated with erosion-resistant materials, such as ceramic, tungsten carbide or other erosion-resistant materials. In one embodiment, inserts 170, 620 may be formed of a heat treated material. In one embodiment, inserts 170, 620 may be made of ceramic. In another embodiment, inserts 170, 620 may be ceramic coated, tungsten-carbide coated or coated with another erosion-resistant material. In some embodiments, inserts 170, 620 may be formed of heat treated materials.

Embodiments of steam diversion assemblies described herein are provided by way of explanation. A steam diversion assembly, valve and flow controller may have a variety of constructions. By way of example, but not limitation, valve 110 can be used with embodiments of flow control assembly 318, valve 301 can be used with embodiments of flow control assembly 160, flow control assembly 160 may include inserts 620 or other inserts and flow control assembly 318 may include inserts 170 or other inserts. Furthermore, various components illustrated as a single part may comprise multiple parts and components may be combined into a single part. In one embodiment, a single piece flow controller with an erosion resistant diversion chamber is provided. Moreover, expandable activation device seats may be used in a variety of devices other than steam diversion assemblies. Furthermore, flow control assemblies may be used with, for example, tools that are opened and closed using only a shifting tool.

The activation device (e.g., ball 404 or other activation device) may be formed of a degradable or dissolvable material and may degrade under well conditions. The activation device may also be formed of a non-degradable material and activation devices may be allowed to accumulate at the lower end of the well.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," "in one embodiment."

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

Although the invention has been described with respect to specific embodiments thereof, these embodiments are merely illustrative, and not restrictive of the invention. The description herein of illustrated embodiments of the invention, including the description in the Abstract and Summary, is not intended to be exhaustive or to limit the invention to the precise forms disclosed herein (and in particular, the inclusion of any particular embodiment, feature or function within the Abstract or Summary is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function, including any such embodiment feature or function described in the Abstract or Summary. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the scope and spirit of the invention.

We claim:

1. A steam diversion assembly for operations in a wellbore, comprising:

a housing having an opening through the housing and having a central bore for directing steam through the housing;

a first sleeve movable within the housing from a valve closed position covering the opening to a valve open position exposing the opening to the central bore of the steam diversion assembly to allow steam to flow outside of the steam diversion assembly;

an expandable seat movable to shift the first sleeve from the valve closed position to the valve open position, the expandable seat expandable from a first seat configuration having a first inner diameter selected to seat an activation device, to a second seat configuration with a second inner diameter selected to allow the activation device to pass the expandable seat; and an inner sleeve movable, relative to the first sleeve, by the expandable seat, from a first inner sleeve position when the expandable seat is retained in a seat retaining area, to a second inner sleeve position when the expandable seat is expanded in an expansion area created when the inner sleeve moves from the first inner sleeve position to the second inner sleeve position.

2. The steam diversion assembly of claim 1, wherein the first sleeve defines the seat retaining area and the seat expansion area, the expandable seat is movable from the seat retaining area to the seat expansion area, the expandable seat changes from the first seat configuration to the second seat configuration when it moves from the seat retaining area to the seat expansion area, and the seat expansion area has a larger inner diameter than the seat retaining area.

3. The steam diversion assembly of claim 1, further comprising;

a first releasable seat engagement mechanism that retains the expandable seat in the seat retaining area such that the expandable seat and first sleeve move together; and a second releasable seat engagement mechanism that allows the expandable seat to move relative to the first sleeve from the seat retaining area to the seat expansion area.

4. The steam diversion assembly of claim 1, wherein the first sleeve has a sleeve opening through the sleeve, the sleeve opening positioned to overlap the opening through the housing when the first sleeve is in the valve open position.

5. The steam diversion assembly of claim 1, wherein the first sleeve is movable from the valve open position to the valve closed position to reclose the valve.

6. The steam diversion assembly of claim 1, further comprising:

a first releasable setting mechanism to prevent the first sleeve from shifting from the valve closed position to the valve open position until a first threshold force is applied to the expandable seat; and a second releasable setting mechanism to prevent the expandable seat from moving relative to the first sleeve from the seat retaining area to the seat expansion area until a second threshold force is applied to the expandable seat, the second threshold force greater than the first threshold force.

7. The steam diversion assembly of claim 1, further comprising a second sleeve movable within the housing, the second sleeve movable from a first position in which the second sleeve does not cover the opening through the housing to a second sleeve closed position in which the second sleeve covers the opening through the housing.

8. A method of injecting steam into a wellbore comprising:

running in an injection string into a wellbore, the injection string comprising a plurality of steam diversion assemblies, each steam diversion assembly of the plurality of steam diversion assemblies comprising a valve with an expandable activation device seat and an associated flow control assembly, and for each respective steam diversion assembly, the valve being openable to divert steam to its associated flow control assembly;

conveying a series of activation devices down the injection string to selectively open the valve of each steam diversion assembly of the plurality of steam diversion assemblies; and pumping steam down the injection string and into the wellbore through the plurality of steam diversion assemblies, wherein the deepest steam diversion assembly of the plurality of steam diversion assemblies has a less restrictive flow control assembly than the shallowest steam diversion assembly of the plurality of steam diversion assemblies.

9. The method of claim 8 wherein the valve of each steam diversion assembly of the plurality of steam diversion assemblies, is opened by landing a corresponding activation device in the series of activation devices, on the expandable activation device seat of said valve.

10. The method of claim 9, further comprising, at each respective steam diversion assembly of the plurality of steam diversion assemblies, expanding the expandable activation device seat after the valve has been opened, to allow the corresponding activation device to pass through the respective steam diversion assembly.

11. The method of claim 8, further comprising closing the plurality of steam diversion assemblies using a shifting tool.

* * * * *